US012305478B2

(12) United States Patent
An et al.

(10) Patent No.: US 12,305,478 B2
(45) Date of Patent: May 20, 2025

(54) EVALUATING CHOKE VALVE PERFORMANCE DURING SUBTERRANEAN FIELD OPERATIONS

(71) Applicant: Chevron U.S.A. Inc., San Ramon, CA (US)

(72) Inventors: Hailing An, Houston, TX (US); James Nileshwar, Perth (AU)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 18/854,964

(22) PCT Filed: May 2, 2022

(86) PCT No.: PCT/US2022/027276

§ 371 (c)(1),
(2) Date: Oct. 7, 2024

(87) PCT Pub. No.: WO2023/214958

PCT Pub. Date: Nov. 9, 2023

(65) Prior Publication Data

US 2025/0109652 A1 Apr. 3, 2025

(51) Int. Cl.
*E21B 34/02* (2006.01)
*E21B 47/06* (2012.01)

(52) U.S. Cl.
CPC ..... *E21B 34/025* (2020.05); *E21B 47/06* (2013.01)

(58) Field of Classification Search
CPC ..... E21B 34/025; E21B 47/06; E21B 47/07; E21B 34/04; E21B 34/02; E21B 34/00
See application file for complete search history.

(56) References Cited

U.S. PATENT DOCUMENTS

2016/0341029 A1 11/2016 Phillips et al.
2017/0293835 A1 10/2017 AlAjmi et al.
(Continued)

FOREIGN PATENT DOCUMENTS

GB 2541926 A * 3/2017 ..... E21B 21/08

OTHER PUBLICATIONS

Taina Matos, PCT International Search Report, Aug. 3, 2022, 2 pages, US as receiving office.
(Continued)

*Primary Examiner* — Caroline N Butcher
(74) *Attorney, Agent, or Firm* — Smith & Woldesenbet Law Group, PLLC

(57) ABSTRACT

A method for evaluating performance of a choke valve includes collecting baseline performance data for the choke valve during a first time period; establishing a relationship between a flow area and positions of the choke valve for the first time period; collecting measurements of parameters associated with the choke valve during a second time period; generating a predicted flow area of the choke valve during a second time period;, generating an estimated flow area through the choke valve during the second time period using the relationship established during the first time period; comparing the estimated flow area with the predicted flow area for the second time period; and determining that the performance of the choke valve is no longer within the range of acceptable performance values when a difference between the estimated and predicted flow areas for the second time period falls outside a range of threshold values.

20 Claims, 13 Drawing Sheets

(56) References Cited

U.S. PATENT DOCUMENTS

| | | | | |
|---|---|---|---|---|
| 2018/0016897 | A1 | 1/2018 | Willberg et al. | |
| 2018/0171759 | A1 | 6/2018 | Meyer et al. | |
| 2021/0096010 | A1* | 4/2021 | Rincon | E21B 47/06 |
| 2021/0096277 | A1 | 4/2021 | Zaki et al. | |
| 2021/0355785 | A1 | 11/2021 | Ahmari | |
| 2022/0065099 | A1* | 3/2022 | Johnson | E21B 34/025 |

OTHER PUBLICATIONS

Taina Matos, Written Opinion of the International Search Authority, Aug. 3, 2022, 8 pages, US as receiving office.

S. Rastoin et al., A Review of Multiphase Flow Through Chokes, Journal of Energy Resources Technology, vol. 119, pp. 1-10, Mar. 1997, The American Society of Mechanical Engineers.

R. Sachdeva et al., Two-Phase Flow Through Chokes, Society of Petroleum Engineers SPE 15657, presented at the 61st Annual Technical Conference and Exhibition of the Society of Petroleum Engineers in New Orleans, Louisiana, U.S.A. on Oct. 5-8, 1986, 12 pages.

T.K. Perkins, Critical and Subcritical Flow of Multiphase Mixtures Through Chokes, SPE Drilling & Completion, Dec. 1993, Society of Petroleum Engineers, 6 pages.

F.E. Ashford et al., Determining Multiphase Pressure Drops and Flow Capacities in Down-Hole Safety Valves, Journal of Petrloeum Technology, Sep. 1975, pp. 1145-1152 (8 pages).

* cited by examiner

EVALUATING CHOKE VALVE PERFORMANCE DURING SUBTERRANEAN FIELD OPERATIONS

CROSS-REFERENCE TO RELATED APPLICATIONS

This application claims priority under 35 U.S.C. § 371 to Patent Cooperation Treaty Patent Application Serial Number PCT/US2022/027276, titled "Evaluating Choke Valve Performance During Subterranean Field Operations" and filed on May 2, 2022, the entire contents of which are hereby incorporated herein by reference.

TECHNICAL FIELD

The present application is related to wellbore operations and, more particularly, to systems and methods for evaluating choke valve performance during subterranean field operations.

BACKGROUND

Choke valves (also sometimes more simply referred to as chokes) are service valves that are used in subterranean field operations for extracting subterranean resources (e.g., oil, gas) from a subterranean formation and/or injecting resources (e.g., carbon dioxide) into a subterranean formation. Choke valves are used in land-based and offshore operations. Choke valves control the flow on production and/or reinjection wells. Choke valves are subjected to extreme conditions (e.g., high pressure, high temperature, high flow rate, multiphase fluids, slugging, sand production), which can cause erosion, corrosion, plugging, and/or other damage. Also, a choke valve has to have a very high turndown capability because it has to cover a wide range of flowrates. Therefore, the design of choke valves must be very robust. Choke valves are made with a number of different configurations, flow path profiles, and materials. Choke valves can be operated manually or automatically.

In subsea applications, choke valves also have to cope with severe marine environmental conditions (e.g., salt water). If a choke valve is selected poorly, it fails early in a field operation, resulting in significant costs related to maintenance and rig time to get the choke valve replaced before operations can resume. Again, in subsea environments, repairing or replacing a choke valve adds even more cost because of the underwater environment, often at great depths.

SUMMARY

In general, in one aspect, the disclosure relates to a method for evaluating performance of a choke valve during a field operation of a subterranean formation. The method can include collecting baseline performance data for the choke valve during a first time period during the field operation, where the choke valve has a fluid flowing therethrough during the first time period. The method can also include establishing, based on evaluating the baseline performance data, a relationship between a flow area of the choke valve and an initial position of the choke valve for the first time period. The method can further include generating, using the relationship established for the first time period and assuming that a performance of the choke valve is within an acceptable range of performance values, a predicted flow area of the choke valve during a second time period that proceeds the first time period. The method can also include collecting, using a sensor device, measurements of a parameter associated with the choke valve during the second time period. The method can further include generating, using the measurements of the parameter, an estimated flow area through the choke valve during the second time period, where the fluid flows through the choke valve during the second time period. The method can also include comparing the estimated flow area with the predicted flow area for the second time period. The method can further include determining that the performance of the choke valve is no longer within the range of acceptable performance values when a difference between the estimated flow area with the predicted flow area for the second time period falls outside a range of threshold values.

In another aspect, the disclosure relates to a system for evaluating performance of a choke valve during a field operation of a subterranean formation. The system can include a first sensor device for measuring a parameter associated with a fluid upstream of the choke valve during the field operation. The system can also include a second sensor device for measuring the parameter associated with the fluid downstream of the choke valve during the field operation. The system can further include a controller communicably coupled to the first sensor device and the second sensor device. The controller can be configured to collect, from the first sensor device and the second sensor device, baseline performance data for the choke valve during a first time period of the field operation during the field operation, where the choke valve has the fluid flowing therethrough during the first time period. The controller can also be configured to establish, based on evaluating the baseline performance data, a relationship between a flow area of the choke valve and an initial position of the choke valve for the first time period. The controller can further be configured to generate, using the relationship established for the first time period and assuming that the performance of the choke valve is within a range of acceptable performance values, a predicted flow area of the choke valve during a second time period that proceeds the first time period. The controller can also be configured to collect, from the first sensor device and the second sensor device, measurements of the parameter associated with the choke valve during the second time period. The controller can further be configured to generate, using the measurements of the parameter, an estimated flow area through the choke valve during the second time period, where the fluid flows through the choke valve during the second time period. The controller can also be configured to compare the estimated flow area with the predicted flow area for the second time period. The controller can further be configured to determine that the performance of the choke valve is no longer within the range of acceptable performance values when a difference between the estimated flow area and the predicted flow area for the second time period falls outside a range of threshold values.

In yet another aspect, the disclosure relates to a non-transitory computer readable medium comprising computer readable program code, which when executed by a computer processor, enables the computer processor to: collect baseline performance data for the choke valve during a first time period during the field operation, where the choke valve has a fluid flowing therethrough during the first time period; establish, based on evaluating the baseline performance data, a relationship between a flow area of the choke valve and an initial position of the choke valve for the first time period; generate, using the relationship established for the first time period and assuming that a performance of the choke valve is within a range of acceptable performance values, a predicted flow area of the choke valve during a second time period that proceeds the first time period; collect, using a sensor device, measurements of a parameter associated with the choke valve during the second time period; generate, using the measurements of the parameter, an estimated flow area through the choke valve during the second time period, where the fluid flows through the choke valve during the second time period; compare the estimated flow area with the predicted flow area for the second time period; and determine that the performance of the choke valve is no longer within the range of acceptable performance values when a difference between the estimated flow area with the predicted flow area for the second time period falls outside the range of threshold values.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DESCRIPTION OF THE INVENTION

Figure 1:
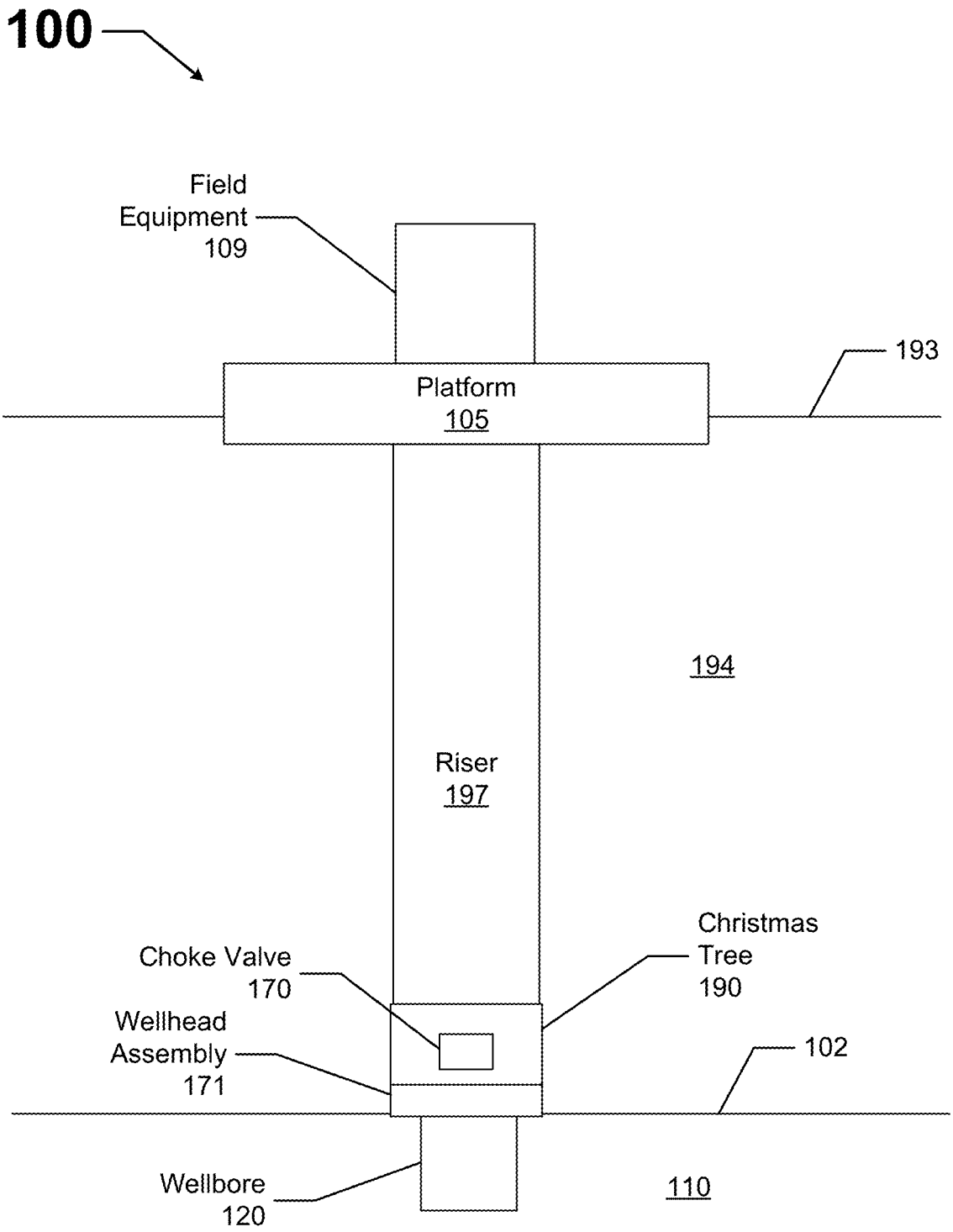
FIG. 1 shows a system used in a subterranean field operation in which example embodiments can be used.

The example embodiments discussed herein are directed to systems and methods for evaluating choke valve performance during subterranean field operations. Field operations involve drilling and completing subterranean wellbores to extract a subterranean resource. Examples of a subterranean resource can include, but are not limited to, natural gas, oil, and water. Field operations for which example embodiments can be used can be land-based or subsea. In addition, or in the alternative, a choke valve that is evaluated can be located in water (e.g., subsea) or out of water (e.g., surface). Example embodiments of systems and methods for evaluating choke valve performance during subterranean field operations can be rated for use in hazardous environments. Example embodiments of systems and methods for evaluating choke valve performance during subterranean field operations can apply when extracting subterranean resources (e.g., oil, gas) from a subterranean formation and/or injecting resources (e.g., carbon dioxide) into a subterranean formation.

When used in certain systems (e.g., for certain subterranean field operations), example embodiments can be designed to help such systems comply with certain standards and/or requirements. Examples of entities that set such standards and/or requirements can include, but are not limited to, the Society of Petroleum Engineers, the American Petroleum Institute (API), the International Standards Organization (ISO), and the Occupational Safety and Health Administration (OSHA). Also, as discussed above, example systems for evaluating choke valve performance can be used in hazardous environments, and so example systems for evaluating choke valve performance can be designed to comply with industry standards that apply to hazardous environments.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings can be capable of being included in one or more claims that correspond to such one or more particular drawings herein.

Example embodiments of systems for evaluating choke valve performance will be described more fully hereinafter with reference to the accompanying drawings, in which example embodiments of systems for evaluating choke valve performance are shown. Systems for evaluating choke valve performance may, however, be embodied in many different forms and should not be construed as limited to the example embodiments set forth herein. Rather, these example embodiments are provided so that this disclosure will be thorough and complete, and will fully convey the scope of systems for evaluating choke valve performance to those of ordinary skill in the art. Like, but not necessarily the same, elements (also sometimes called components) in the various figures are denoted by like reference numerals for consistency.

Terms such as "first", "second", "outer", "inner", "top", "bottom", "upper", "lower", "distal", "proximal", "on", and "within" are used merely to distinguish one component (or part of a component or state of a component) from another. This list of terms is not exclusive. Such terms are not meant to denote a preference or a particular orientation, and they are not meant to limit embodiments of systems for evaluating choke valve performance. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a field system 100 in which the performance of choke valves can be evaluated. The system 100 includes an operational structure 105 that is disposed in a body of water 194. The operational structure can include one or more of a number of components, including but not limited to a platform, a crane, a pontoon, a hull, a leg, and a mooring line. Part (e.g., the platform, the crane) of the operational structure 105 in this example is above the water line 193, and the remainder (e.g., the pontoon, most of the legs) of the operational structure 105 is in the water 194 below the water line 193. The operational structure 105 can be located completely on land with no part of the operational structure 105 in water 194.

The operational structure 105 in this case is used for subterranean field operations, in which production phases of the field operation are executed to extract subterranean resources (e.g., oil, natural gas, water, hydrogen gas) from and/or inject resources (e.g., carbon dioxide) into the subterranean formation 110 through the wellbore 120. To accomplish this, a riser 197 is disposed between the operational structure 105 and the subsea surface 102, and certain field equipment (e.g., casing, tubing string) is disposed within the riser 197. The bottom of the riser 197 close to the subsea surface 102 meets with the top of a subsea Christmas tree 190, which includes a choke valve 170. The subsea Christmas tree 190 is disposed atop a wellhead assembly 171, which is disposed atop the wellbore 120. The wellbore 120 is drilled in the subterranean formation 110. Disposed on the platform of the operational structure 105, toward the top of the riser 197, is field equipment 109 used to perform the field operation. Examples of such field equipment 109 can include, but is not limited to, compressors, meters, motors, pumps, piping, controllers, and sensor devices.

Figure 13:
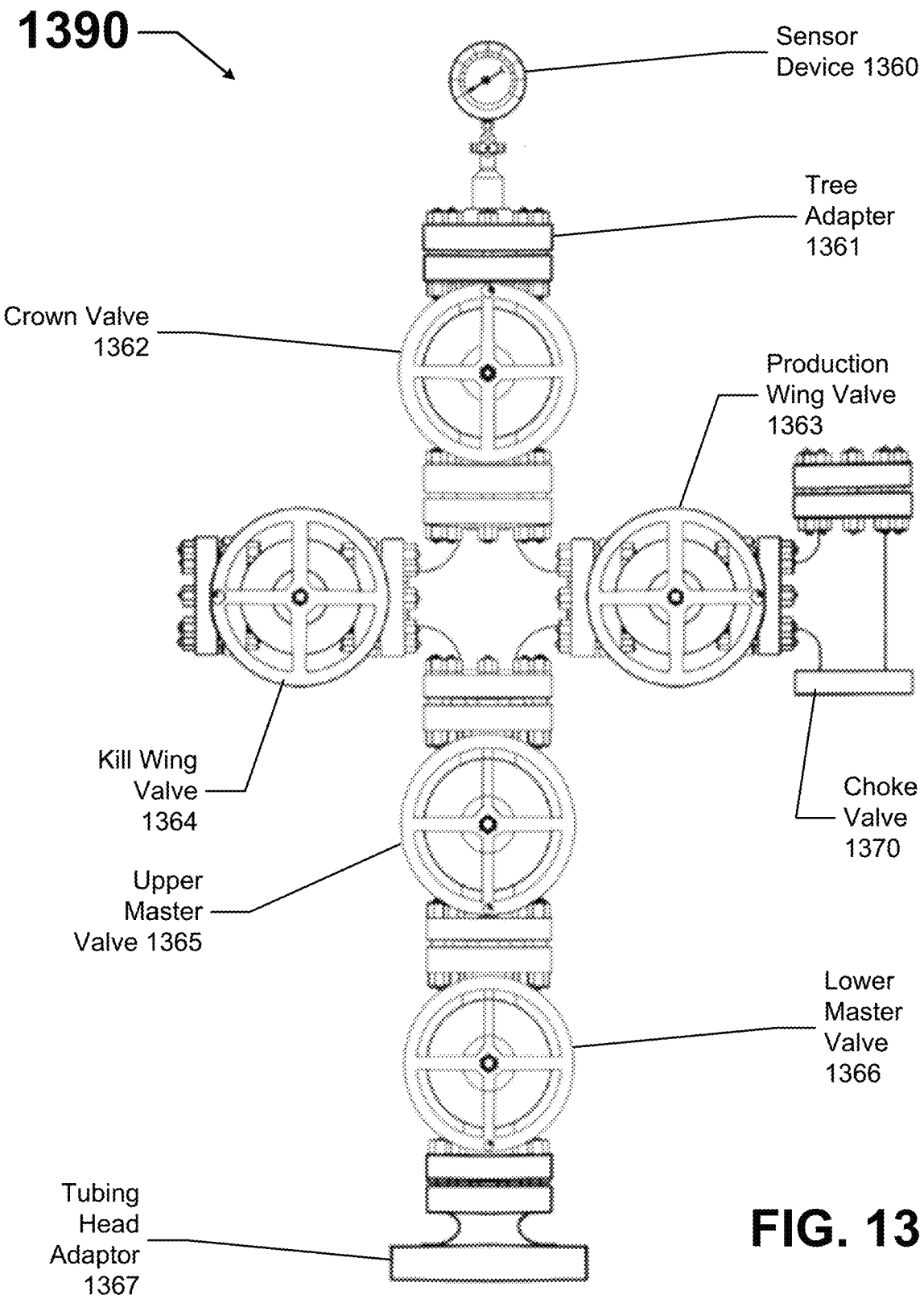
FIG. 13 shows a surface Christmas tree with which example embodiments can be used.

The subsea Christmas tree 190 is a combination of multiple components that are used to regulate the pressure therein during one or more operations (e.g., production) with respect to the wellbore 120 in the subterranean formation 110. Examples of such components of the subsea Christmas tree 190 can include, but are not limited to, one or more valves, one or more accumulators, one or more connectors, one or more gauges, one or more sensor devices, one or more ports, one or more adaptors, and one or more hangers. In addition, in this example, the subsea Christmas tree 190 includes the choke valve 170. The choke valve 170 is configured to control the production rate of the wellbore 120. Examples of a Christmas tree 190 are shown in FIGS. 2 and 13 below.

Figure 2:
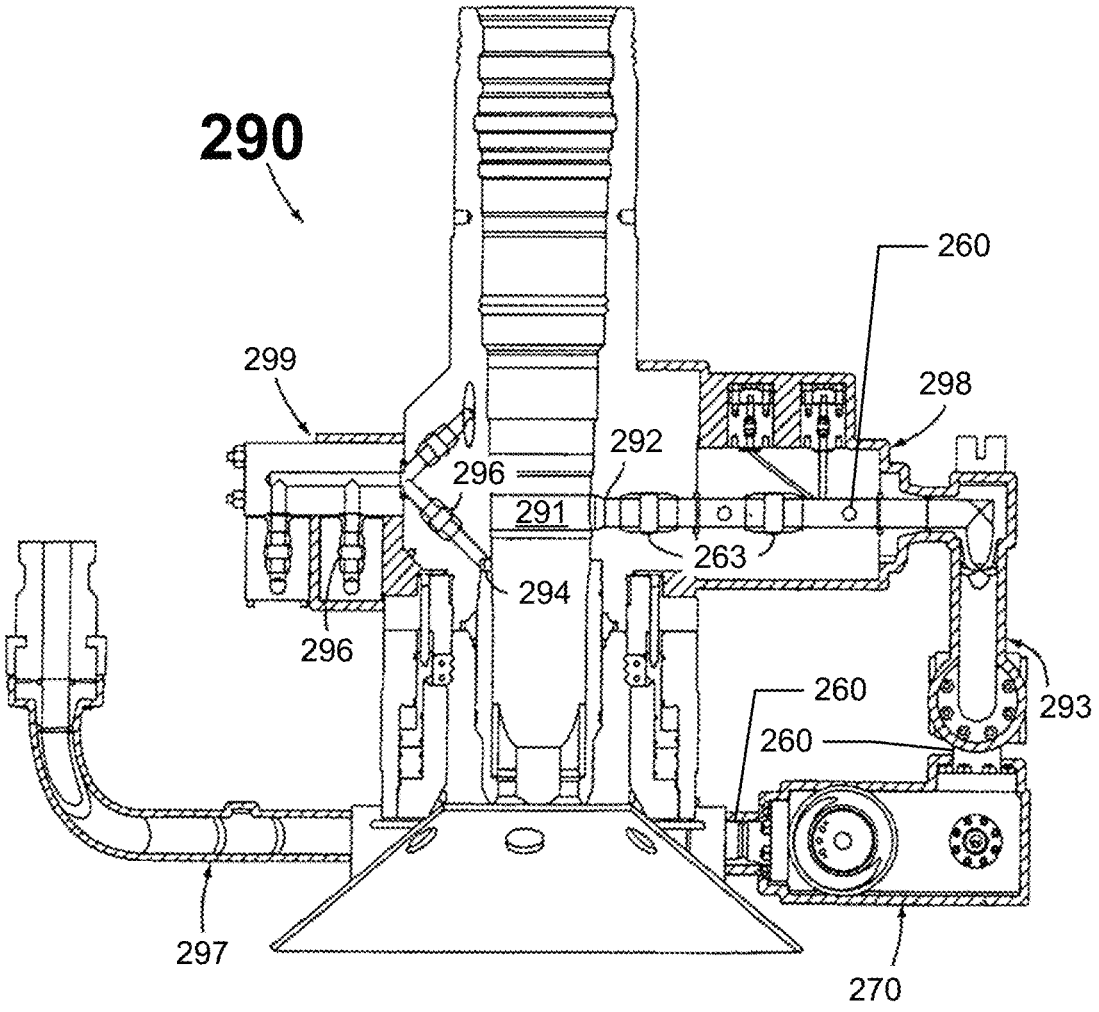
FIG. 2 shows a subsea Christmas tree with which example embodiments can be used.

FIG. 2 shows an example of a subsea Christmas tree 290 used in subterranean field operations. Referring to FIGS. 1 and 2, the subsea Christmas tree 290 of FIG. 2 can be any type of subsea Christmas tree, including but not limited to a horizontal Christmas tree and a vertical Christmas tree. The subsea Christmas tree 290 includes multiple components that are connected to each other. By way of the non-limiting example shown in FIG. 2, the subsea Christmas tree 290 includes an axial production bore 291 in communication with the wellbore (e.g., wellbore 120), a production outlet 292 connected to the production bore 291, one or more production valves 263 for controlling flow through the production outlet 292, a choke valve 270 connected to the production outlet 292 via a flow loop 293, an annulus outlet 294 connected to tubing annulus surrounding production tubing (not shown), one or more annulus valves 296 for controlling flow through the annulus outlet 294, a production flow loop 297 for connecting the production outlet 292 with an undersea pipe (not shown), a production valve block 298 housing one or more of the production valves 263, the choke valve 270, an annulus valve block 299 housing one or more of the annulus valves 296, and multiple sensor devices 260.

The choke valve 270 can have any of a number of configurations, depending on factors such as, but not limited to, the field operation being performed and the location of the choke valve 270. The choke valve 270 is designed to throttle a flow area to control flow rate and pressure. An example of a choke valve that can be evaluated using example embodiments is shown below with respect to FIG. 3.

Figure 3:
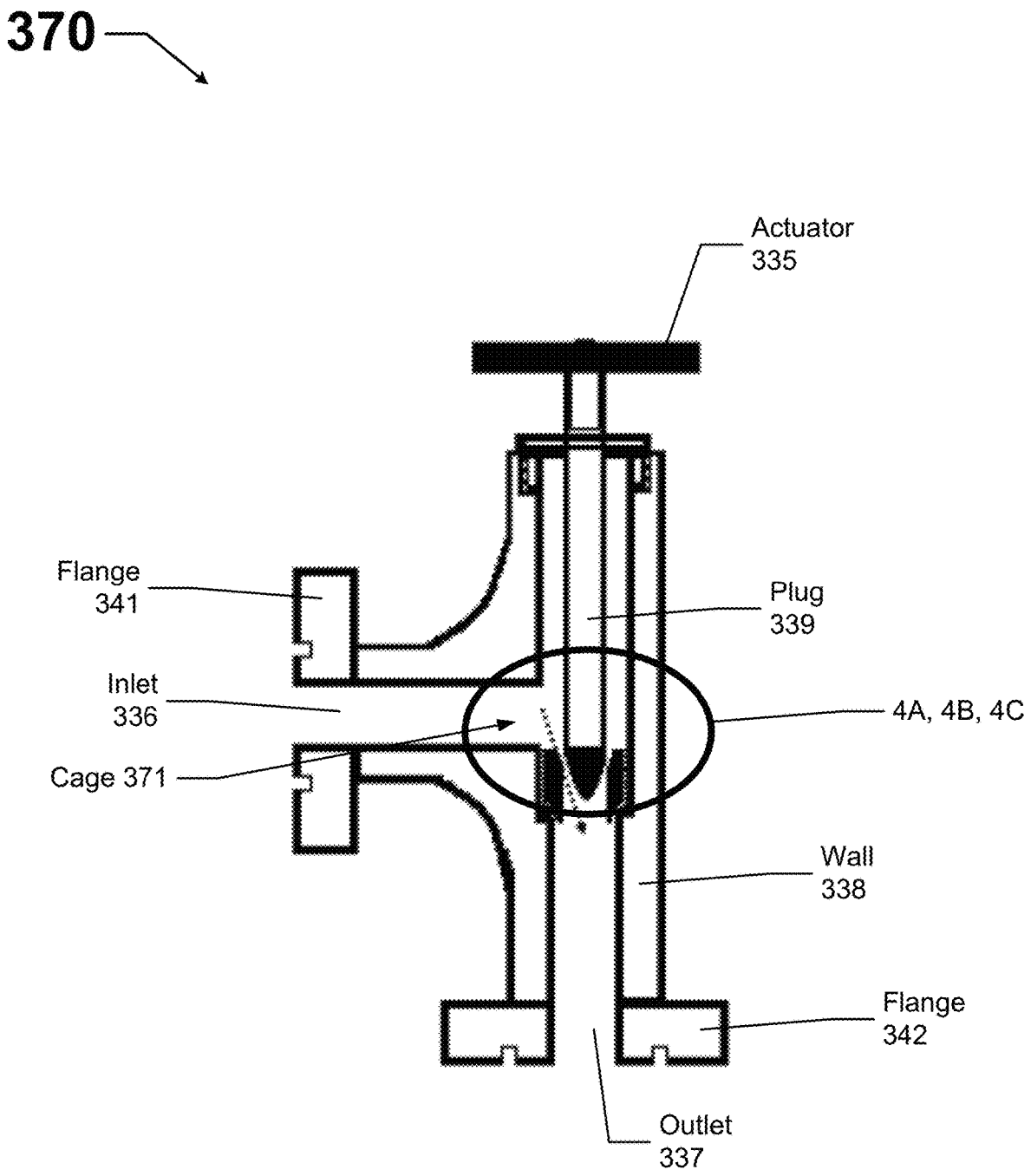
FIG. 3 shows a choke valve with which example embodiments can be used.

FIG. 3 shows a choke valve 370 with which example embodiments can be used. Referring to FIGS. 1 through 3, the choke valve 370 of FIG. 3 includes an actuator 335 (e.g., a handle, a knob, a wheel) that raises or lowers a solid cylinder 339 (also sometimes called a plug 339 or stem 339) which is placed around or inside another cylinder 371 (also sometimes called a cage 371) that has holes or slots (also called channels). Examples of the channels are shown below with respect to FIGS. 4A through 4C. The position of the plug 339 within the cylinder 371 can generally be referred to as the position of the choke valve 370. The design of the choke valve 370 means fluids flowing through the cage 371 are coming from all sides and that the streams of flow (through the channels in the cage 371) collide with each other at the center of the cage 371, thereby dissipating the energy of the fluid through "flow impingement".

The fluid enters the cage 371 from an inlet 336 and leaves the cage 371 through an outlet 337. In this case, the inlet 336 and the outlet 337 are arranged perpendicular to each other. One or more walls 338 of the choke valve 370 forms the inlet 336, the outlet 337, the cage 371, and the part of the choke valve 370 in which the rest of the plug 339 is disposed. A flange 341, disposed at the inlet 336, can include one or more coupling features (e.g., apertures) that can couple the choke valve 370 to another component (e.g., a production wing valve 263) of a Christmas tree (e.g., Christmas tree 290). Similarly, a flange 342, disposed at the outlet 337, can include one or more coupling features (e.g., apertures) that can couple the choke valve 370 to another component of a Christmas tree (e.g., Christmas tree 290).

Figure 4A:
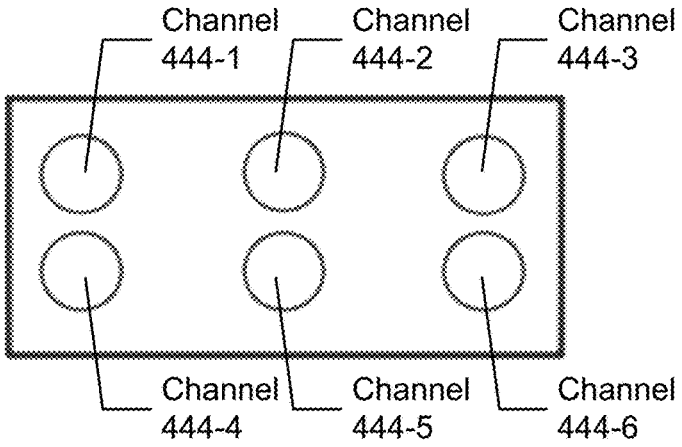
FIGS. 4A through 4C show various states of channels within the choke valve of FIG. 3 that can occur over time during a field operation.
Figure 4B:
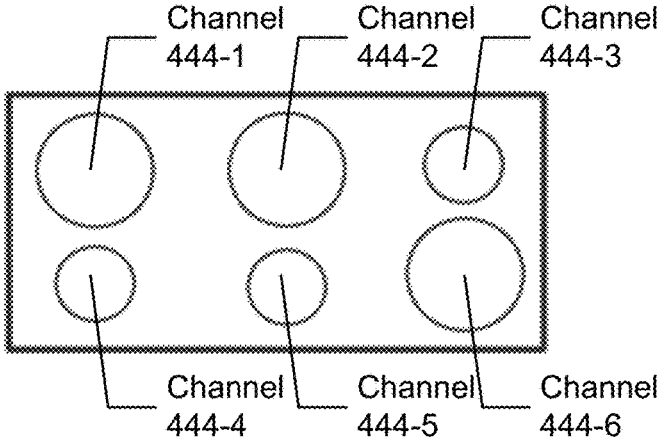
Figure 4C:
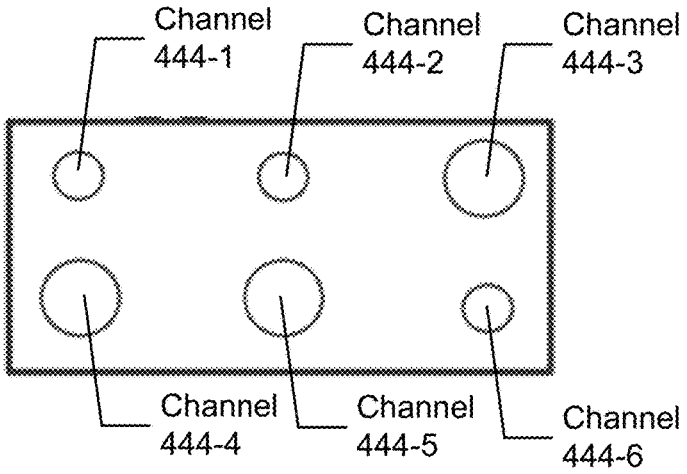

FIGS. 4A through 4C show various states of channels within the choke valve 370 of FIG. 3 that can occur over time during a field operation. Specifically, FIG. 4A shows a sectional view of the six channels 444 (channel 444-1, channel 444-2, channel 444-3, channel 444-4, channel 444-5, and channel 444-6) of the choke valve 370 when the choke valve 370 is new. As a result, the diameter of all six channels 444 in FIG. 4A are normal and substantially uniform relative to each other.

FIG. 4B shows a later point in time after the choke valve 370 has been in use in a subterranean field operation. While the channel 444-3, the channel 444-4, and the channel 444-5 continue to appear to have a normal diameter (i.e., their diameters have not changed substantially relative to their diameter at the time of FIG. 4A), the diameters of the channel 444-1, the channel 444-2, and the channel 444-6 have increased relative to the diameters of those channels 444 at the time of FIG. 4A. The increased diameters indicate that the channel 444-1, the channel 444-2, and the channel 444-6 have all corroded and/or otherwise eroded. While the diameters of the channel 444-1, the channel 444-2, and the channel 444-6 shown in FIG. 4B are relatively equal to each other, the rate of erosion can be non-uniform among the channels 444. Further, while the cross-sectional shape of the channel 444-1, the channel 444-2, and the channel 444-6 shown in FIG. 4B is circular, the erosion of any channel 444 can be non-uniform to distort the circular cross-sectional shape.

FIG. 4C shows a different scenario from FIG. 4B at a later point in time after the choke valve 370 has been in use in a subterranean field operation. As with the scenario shown in FIG. 4B, the channel 444-3, the channel 444-4, and the channel 444-5 continue to appear to have a normal diameter (i.e., their diameters have not changed substantially relative to their diameter at the time of FIG. 4A), the diameters of the channel 444-1, the channel 444-2, and the channel 444-6 have decreased relative to the diameters of those channels 444 at the time of FIG. 4A. The decreased diameters indicate that the channel 444-1, the channel 444-2, and the channel 444-6 have all become partially plugged. While the diameters of the channel 444-1, the channel 444-2, and the channel 444-6 shown in FIG. 4C are relatively equal to each other, the rate of obstruction can be non-uniform among the channels 444. Further, while the cross-sectional shape of the channel 444-1, the channel 444-2, and the channel 444-6 shown in FIG. 4C is circular, the obstruction of any channel 444 can be non-uniform to distort the circular cross-sectional shape.

As illustrated by FIGS. 4B and 4C, the choke valve 370, particularly in subsea conditions, can be subjected to extreme conditions that are typical at wellheads. These extreme conditions can cause erosion, corrosion, and other damage to the channels 444 and/or other parts of the choke valve 370. Erosion of one or more channels 444 in the choke valve 370, as shown in FIG. 4B, can result in increased flowthrough for a given setting (e.g., position of the plug 339 in the cage 371) of the choke valve 370. Plugging of one or more channels 444 of the choke valve 370, as shown in FIG. 4C, can result in decreased flowthrough for a given setting of the choke valve 370. These problems of erosion and plugging can arise during single phase fluid flow or multiphase fluid flow (i.e., a mixture of at least two components such as water, oil, gas, and solids) through the choke valve 370. Also, the choke valve 370 has to have a very high turndown capability in order to cover a wide range of flowrates. As a result, the configuration of the choke valve 370 must be robust in terms of flow path profiles, materials, and ease of maintenance.

When single phase fluids are involved, the flow rate can be calculated using the following equation:

$$Q=C_v(dP/SG)^{1/2}$$

where Q is the flow rate, $C_v$ is a flow coefficient, dP is the pressure differential across the choke valve, and SG is the specific gravity of the fluid. However, if the choke valve through which a single phase fluid is flowing begins to have issues (e.g., corrosion, blockage, imprecise settings), the above equation may not provide accurate results without changing factors such as the flow coefficient, which can be difficult or impossible to determine in real time during a field operation. For multiphase fluids, as what is considered using example embodiments, this equation is replaced by a more complicated equations and models. Unfortunately, when viewed over time, these models tend to be inaccurate relative to actual conditions of the choke valve due to the complex nature of the multiphase flow. Even so, those models are still able to reveal the correlation between flow area through the choke valve and $C_v$ for multiphase fluids. Example embodiments are designed to provide an operator or other user a real-time assessment about the performance of a choke valve during a field operation so that adjustments can be made to the choke valve that will allow the choke valve to operate more effectively for a longer period of time compared to what is available in the current art. Example embodiments can be used with single phase fluids or multiphase fluids.

Figure 5:
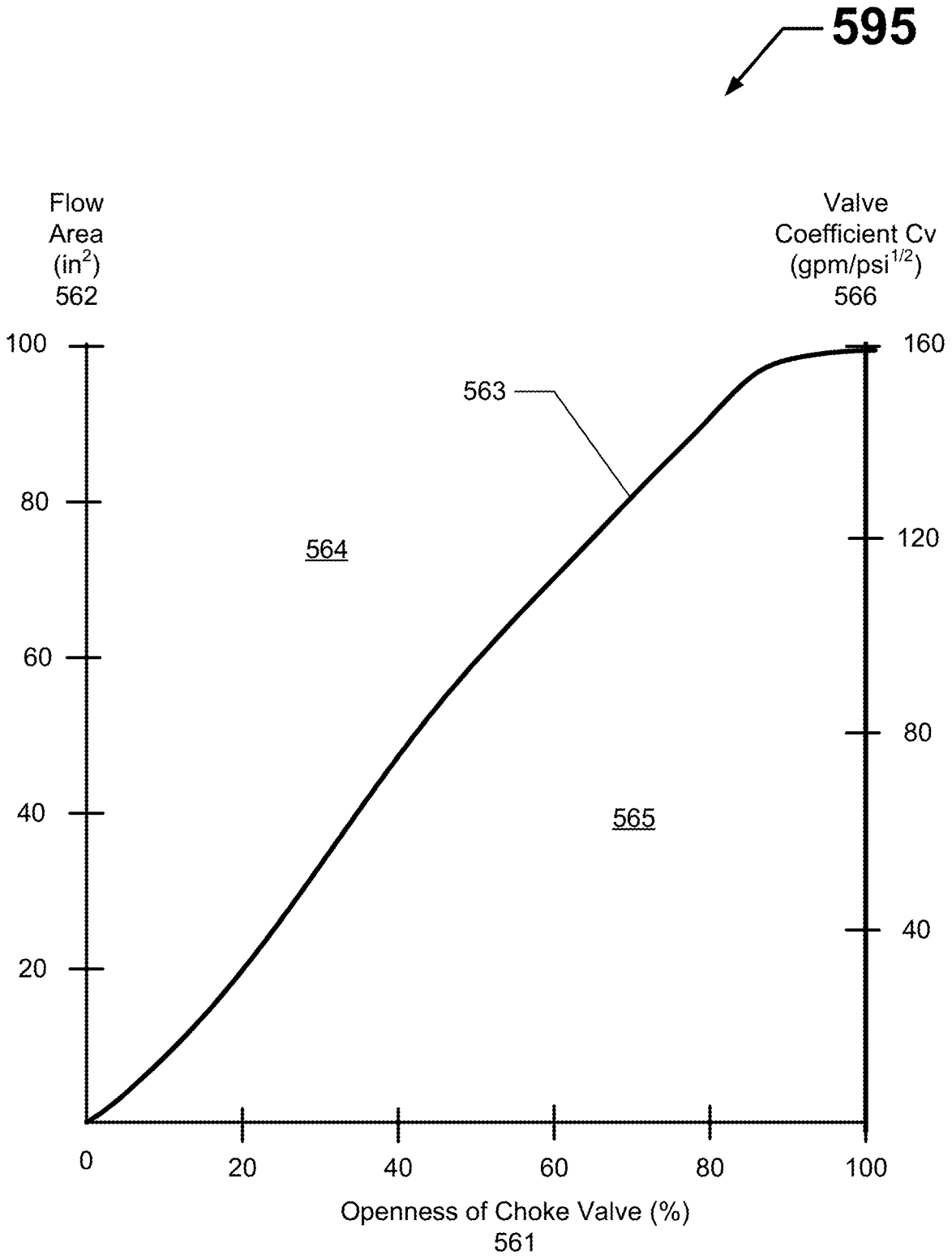
FIG. 5 shows a graph of a performance curve for a choke valve.

FIG. 5 shows a graph 595 of a performance curve 563 for a choke valve (e.g., choke valve 370). Referring to FIGS. 1 through 5, the graph 595 of FIG. 5 plots flow area 562 along a first vertical axis and the valve coefficient $C_v$ 566 along a second vertical axis versus the openness of the choke valve 561 along the horizontal axis. The resulting performance curve 563 rises substantially linearly and represents channels (e.g., channels 444) of a choke valve (e.g., choke valve 370) that remain substantially unchanged over time from their original condition. If one or more channels are eroded, as shown in FIG. 4B, then plot points land in the area 564 above the performance curve 563. Similarly, if one or more channels are congested, as shown in FIG. 4C, then plot points land in the area 565 below the performance curve 563.

If one or more channels of a choke valve are eroded, and an adjustment is not made in real time to the setting of the choke valve to compensate for this erosion, then the erosion becomes worse more quickly. Similarly, if one or more channels of a choke valve are congested, and an adjustment is not made in real time to the setting of the choke valve to compensate for this blockage, then the congestion becomes worse more quickly. In either case, as a result of not being able to compensate in real time for an abnormality in the channels of the choke valve, the useful life of the choke valve is shortened, and time and expense must be incurred to replace the choke valve.

Figure 6:
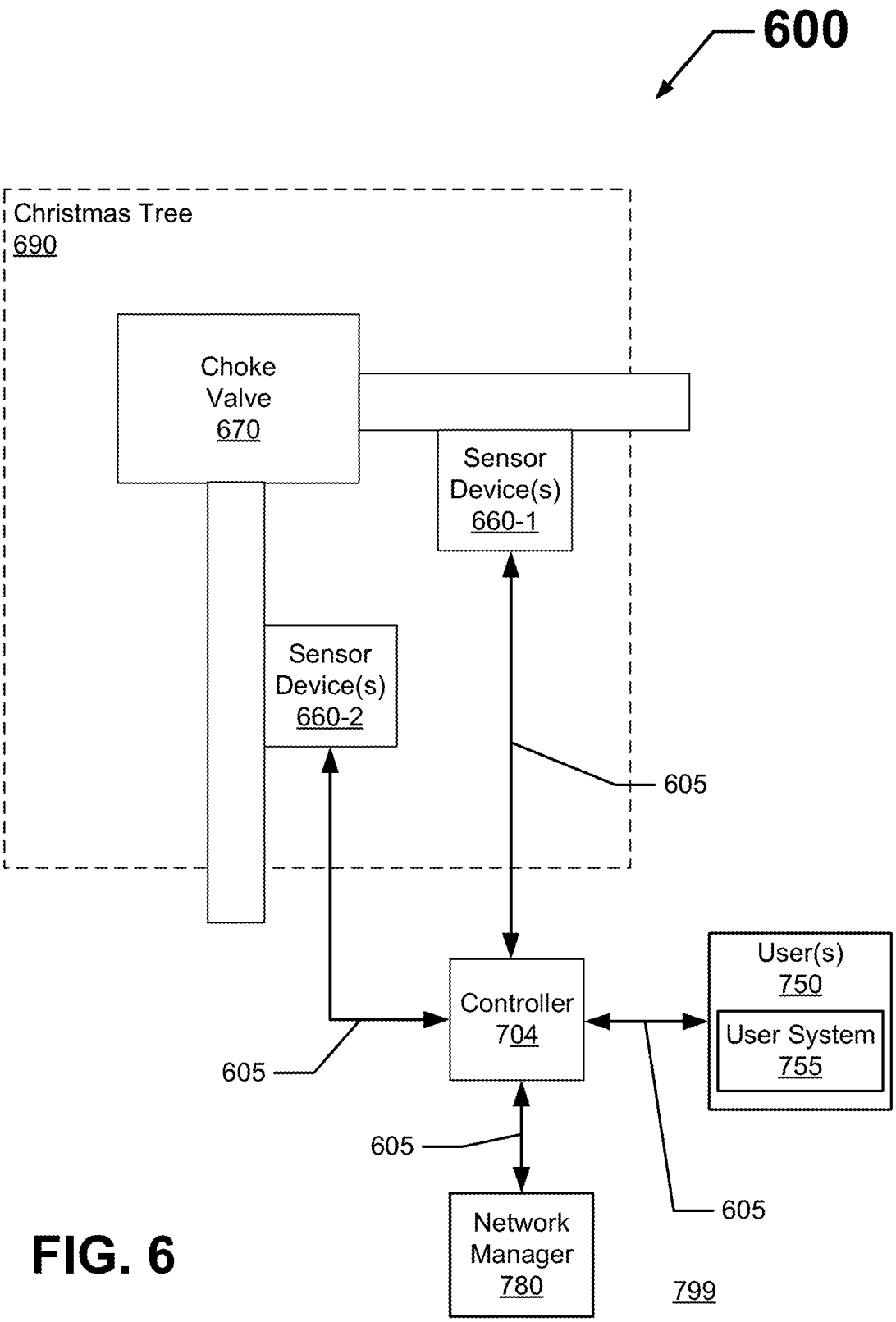
FIG. 6 shows part of a system according to certain example embodiments.
Figure 7:
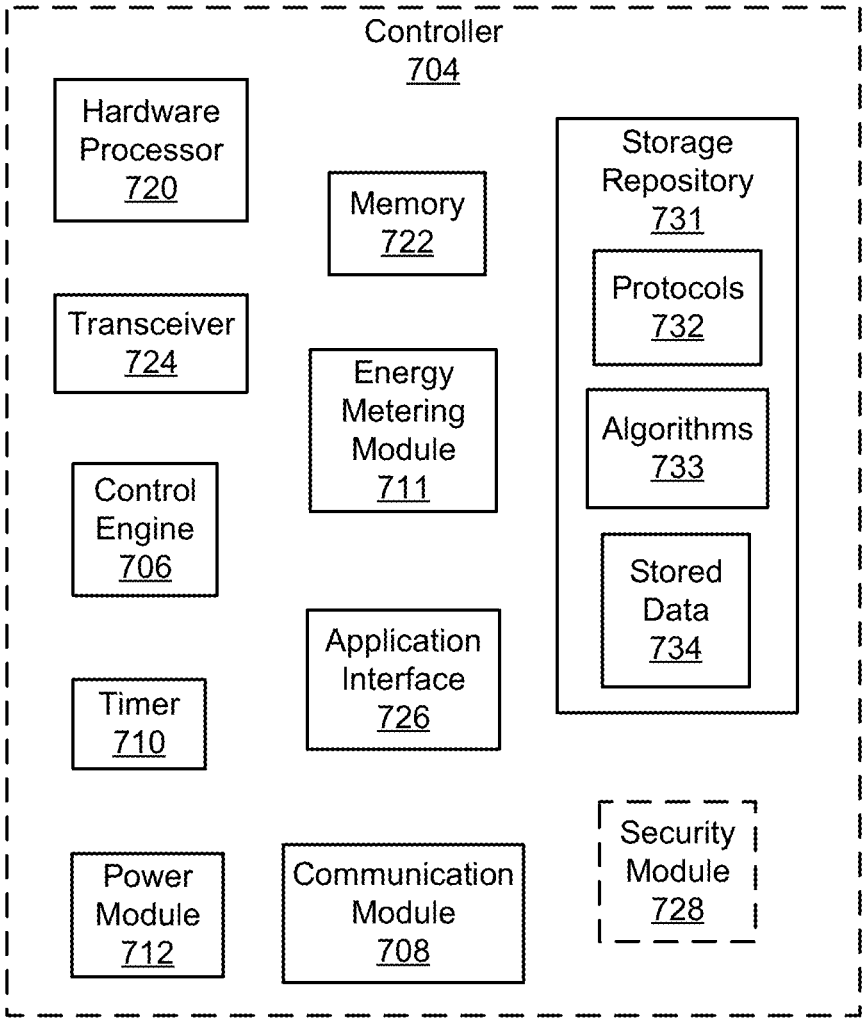
FIG. 7 shows details of the controller of FIG. 6.

FIG. 6 shows part of a system 600 according to certain example embodiments. FIG. 7 shows details of the controller 704 of FIG. 6. Referring to FIGS. 1 through 7, the part of the system 600 of FIG. 6 includes a Christmas tree 690, one or more users 750, a network manager 780, and the controller 704. The Christmas tree 690 includes a choke valve 670, one or more sensor devices 660-1 located upstream of the choke valve 670, and one or more sensor devices 660-2 located downstream of the choke valve 670. The controller 704 is communicably coupled to the sensor devices 660-1, the sensor devices 660-2, the users 750 (including associated user systems 755), and the network manager 780 using communication links 605. The Christmas tree 690 and the choke valve 670 are substantially the same as the Christmas trees and choke valves discussed above with respect to FIGS. 1 through 5.

Each of the sensor devices 660-1 and the sensor devices 660-2 (each more generally referred to as a sensor device 660 or collectively as sensor devices 660) can include one or more of any type of sensor that measures one or more parameters. Examples of types sensors of a sensor device 660 can include, but are not limited to, a temperature sensor, a flow rate sensor, and a pressure sensor. Examples of a parameter that is measured by a sensor of a sensor device 660 can include, but are not limited to, a pressure and/or other factors that can lead to a pressure, a flow rate, a temperature, and flow properties.

In certain example embodiments, a parameter measured by one of the sensor devices 660-1 located upstream of the choke valve 670 is the same as the parameter measured by one of the sensor devices 660-2 located downstream of the choke valve 670. In such a case, the controller 704, upon receiving these measurements, can calculate a differential of that parameter with respect to the choke valve 670 at a point in time. The parameters that can be used for differential measurement include, but are not limited to, pressure.

The parameter or parameters measured by a sensor of a sensor device 660 can be used to evaluate performance of the choke valve 670 in real time during a subterranean field operation. In some cases, each sensor device 660 can also include an energy storage device (e.g., a battery) to provide energy to allow the sensor device 660 to operate. A sensor device 660 can measure a parameter continuously, periodically, based on the occurrence of an event, based on a command received from the controller 704, and/or based on some other factor.

Each parameter measured by a sensor of a sensor device 660 is sent from that sensor device 660 to the controller 704 using one or more communication links 605. Each communication link 605 can include wired (e.g., Class 1 electrical cables, Class 2 electrical cables, electrical connectors, power line carrier, DALI, RS485, UART, SPI, I2C) and/or wireless (e.g., Wi-Fi, visible light communication, cellular networking, visible light communication (VLC), 802.15.4 wireless, ZigBee, 4G cellular wireless, Bluetooth, WirelessHART, ISA100) technology.

In some cases, a sensor device 660 can be an integrated sensor. An integrated sensor has both the ability to sense and measure at least one parameter and the ability to communicate with another component (e.g., the controller 704, another sensor device 660-1). The communication capability of a sensor device 660 that is an integrated sensor can include one or more communication devices that are configured to communicate with, for example, the controller 704 and/or another sensor device 660-2. For example, an integrated sensor device 660 can include a pressure sensor and a transceiver that sends and receives communication signals using one or more communication links 605.

Each integrated sensor device 660 can use one or more of a number of communication protocols. This allows a sensor device 660 to communicate with one or more components of the system 600. The communication capability of a sensor device 660 that is an integrated sensor can be dedicated to the sensor device 660 and/or shared with the controller 704 and/or one or more other sensor devices 660. An example of an integrated sensor device is shown below with respect to FIG. 8.

If the communication capability of a sensor device 660 that is an integrated sensor is dedicated to the sensor device 660, then the sensor device 660 can include one or more components (e.g., a transceiver, a communication module), or portions thereof, that are substantially similar to the corresponding components described below with respect to the controller 704. A sensor device 660 can be associated with a component (e.g., the upper master valve 265) of the Christmas tree 690 and/or other component of the system 600. A sensor device 660 can be located within a wall or housing of a component of the system 600, disposed on a wall or housing of a component of the system 600, or located outside of a wall or housing of a component of the system 600. In some cases, a sensor device 660 is a stand-alone component of the system 600.

In certain example embodiments, a sensor device 660 can include an energy storage device (e.g., a battery) that is used to provide power, at least in part, to some or all of the sensor device 660. The optional energy storage device of the sensor module 660 can operate at all times or when the sensor device 660 is operating. Further, a sensor device 660 can utilize or include one or more components (e.g., memory, storage repository, transceiver) found in the controller 704. In such a case, the controller 704 can provide the functionality of these components used by the sensor device 660. Alternatively, the sensor device 660 can include, either on its own or in shared responsibility with the controller 704, one or more of the components of the controller 704. In such a case, the sensor device 660 can correspond to a computer system as described below with regard to FIG. 9.

A user 750 may be any person that interacts with subterranean field operations. Examples of a user 750 may include, but are not limited to, a drilling engineer, a service engineer, a company representative, an inventory management system, an inventory manager, a labor scheduling system, a software developer, a contractor, and a manufacturer's representative. A user 750 can use a user system 755 (also sometimes called a user device 755 herein), which may include a display (e.g., a GUI).

A user system 755 of a user 750 interacts with (e.g., sends data to, receives data from) the controller 704 via the application interface 726 (described below). Examples of a user system 755 can include, but are not limited to, a cell phone with an app, a laptop computer, a handheld device, a smart watch, a desktop computer, and an electronic tablet. In some cases, a user 750 (including an associated user system 755) can also interact with a network manager 780 and/or one or more of the sensor devices 660 in the system 600 using one or more communication links 705.

The network manager 780 is a device or component that controls all or a portion of a communication network that includes the controller 704 (including components thereof). The network manager 780 can be substantially similar to the controller 704. Alternatively, the network manager 780 can include one or more of a number of features in addition to, or altered from, the features of the controller 704 described below. As described herein, communication with the network manager 780 can include communicating with one or more other components (e.g., a user system 755) of the system 600. In such a case, the network manager 780 can facilitate such communication. There can be more than one network manager 780 and/or one or more portions of a network manager 780. The network manager 780 can also be called by other names in the art, including but not limited to a master controller, an enterprise manager, a system manager, and a system controller.

The controller 704, a user 750 (including an associated user system 755), and/or the network manager 780 can use their own system or share a system in certain example embodiments. Such a system can be, or contain a form of, an Internet-based or an intranet-based computer system that is capable of communicating with various software. A computer system includes any type of computing device and/or communication device, including but not limited to the controller 704. Examples of such a system can include, but are not limited to, a desktop computer with a Local Area Network (LAN), a Wide Area Network (WAN), Internet or intranet access, a laptop computer with LAN, WAN, Internet or intranet access, a smart phone, a server, a server farm, an android device (or equivalent), a tablet, smartphones, and a personal digital assistant (PDA). Such a system can correspond to a computer system as described below with regard to FIG. 9.

Further, as discussed above, such a system can have corresponding software (e.g., user software, network manager software). The software can execute on the same or a separate device (e.g., a server, mainframe, desktop personal computer (PC), laptop, PDA, television, cable box, satellite box, kiosk, telephone, mobile phone, or other computing devices) and can be coupled by the communication network (e.g., Internet, Intranet, Extranet, LAN, WAN, or other network communication methods) and/or communication channels, with wire and/or wireless segments according to some example embodiments. The software of one system can be a part of, or operate separately but in conjunction with, the software of another system within the system 600.

In certain example embodiments, the controller 704 of the system 600 is configured to receive the measurements made by each of the sensor devices 660. The controller 704 is further configured to use these sensor measurements to evaluate the performance of the choke valve 670 during a subterranean field operation in real time. The controller 704 can also be configured to determine and communicate, in real time, an adjustment that can be made to the choke valve 670 to improve the performance of the choke valve 670 and extend the useful life of the choke valve 670. The controller can further be configured to adjust a performance curve of the choke valve 670 for a forward-looking period of time based on an estimated flow area of the choke valve 670 (using measurements made by the sensor devices 660) and a previously-established performance curve corresponding to a predicted flow area of the choke valve 670.

The controller 704 can include one or more of a number of components. As shown in FIG. 7, such components, can include, but are not limited to, a control engine 706, a communication module 708, a timer 710, an energy metering module 711, a power module 712, a storage repository 730, a hardware processor 720, a memory 722, a transceiver 724, an application interface 726, and, optionally, a security module 728. The components of the controller 704 shown in FIG. 7 are not exhaustive. Any component of the example controller 704 can be discrete or combined with one or more other components of the controller 704. The controller 704 (or portions thereof) is located in a volume of space 799 that can be indoors and/or outdoors and include any of a number of types of environments (e.g., climate-controlled, humid, water-rated, corrosive, hazardous, office space). As an example, the controller 704 can be located on a platform used during the subterranean field operation. As another example, the controller 704 can be located in an office located remotely from the subterranean field operation.

The storage repository 730 of the controller 704 can be a persistent storage device (or set of devices) that stores software and data used to assist the controller 704 in communicating with the user 750 (including an associated user system 755), one or more of the sensor devices 660, and/or the network manager 780 within the system 600. In one or more example embodiments, the storage repository 730 stores one or more protocols 732, one or more algorithms 733, and stored data 734. The protocols 732 of the storage repository 730 can be any procedures (e.g., a series of method steps) and/or other similar operational procedures that the control engine 706 of the controller 704 follows based on certain conditions at a point in time.

An example of a protocol 732 is setting a number of times that a data point (as generated by the controller 704 using measurements from at least some of the sensor devices 660 and one or more algorithms 733) falls outside a range of threshold values. Another example of a protocol 732 is a method for converting measurements made by sensor devices 660 at the surface to subsea conditions using a PVT (pressure volume temperature) table for the subterranean field.

The protocols 732 can include any of a number of communication protocols that are used to send and/or receive data between the controller 704 and a user 750 (including an associated user system 755), one or more of the sensor devices 660, and the network manager 780. A protocol 732 can also include a process for evaluating the performance of the choke valve 670 in the system 600 in real time. One or more of the protocols 732 can be a time-synchronized protocol. Examples of such time-synchronized protocols can include, but are not limited to, a highway addressable remote transducer (HART) protocol, a wirelessHART protocol, and an International Society of Automation (ISA) 100 protocol. In this way, one or more of the protocols 732 can provide a layer of security to the data transferred within the system 600.

The algorithms 733 of the storage repository 730 can be any formulas, mathematical models, forecasts, simulations, and/or other similar tools that the control engine 706 of the controller 704 uses to reach a computational conclusion. An example of one or more algorithms 733 can be or include a model that predicts a relationship between flow area through the choke valve 670 and the position of the plug (e.g., plug 339) of the choke valve 670 (indicating the amount that the choke valve 670 is open or closed) over time. As another example, one or more algorithms 733 can be or include a model that estimates, in real time, a flow area through the choke valve 670 in real time using parameters (e.g., pressure, temperature, flow rate, flow properties) measured by at least some of the sensor devices 660. As another example, one or more algorithms 733 can be or include a model that determines, in real time, that the performance of the choke valve 670 is no longer within a range of acceptable performance values based on the estimated flow area, based on choke position and the predicted flow area, etc.

As still another example, one or more algorithms 733 can be or include a model that determines an amount of adjustment of the position of the plug of the choke valve 670 that should be made to extend the useful life of the choke valve 670 by reducing the amount of erosion or obstruction that the choke valve 670 experiences. As yet another example, one or more of the algorithms 733 can be or include a model that revises the predicted relationship between flow area through the choke valve 670 and the position of the plug of the choke valve 670 over time, looking forward, during a subterranean field operation. As still another example, one or more of the algorithms 733 can be or include a model that adjusts a performance curve of the choke valve 670 for a forward-looking period of time based on an estimated flow area of the choke valve 670 (using measurements made by the sensor devices 660) and a previously-established performance curve corresponding to a predicted flow area of the choke valve 670.

Algorithms 733 can be used to analyze past data, analyze current data, and/or perform forecasts. An algorithm 733 can be fixed or modified (e.g., by a user 750, by the control engine 706) over time. Modification of an algorithm 733 can be based on one or more of a number of factors, including but not limited to correction based on actual data measured by one or more of the sensor devices 660, input from a user 750 or associated user system 755, changes in a protocol 732, and changes in a related algorithm 733.

Stored data 734 of the storage repository 730 can be any data (e.g., nameplate data, manufacturing information) associated with a component (e.g., each sensor device 660, the choke valve 670) of the system 600 used during a subterranean field operation, any measurements made by the sensor devices 660, threshold values, PVT tables for one or more subterranean fields, results of previously run or calculated algorithms 733, data (e.g., sensor measurements, results of algorithms, predicted flow area through a choke valve, estimated flow area through a choke valve) associated with other field operations having subterranean characteristics and/or choke valves similar to those of the present subterranean field operation, user preferences, threshold values, a range of acceptable performance values of the choke valve at a given point or time period during the field operation, and/or any other suitable data. Such data can be any type of data, including but not limited to historical data, current data, and forecasts. The stored data 734 can be associated with some measurement of time derived, for example, from the timer 710.

Examples of a storage repository 730 can include, but are not limited to, a database (or a number of databases), a file system, a hard drive, flash memory, some other form of solid state data storage, cloud-based storage, or any suitable combination thereof. The storage repository 730 can be located on multiple physical machines (e.g., the controller 704, the network manager 780, the cloud), each storing all or a portion of the protocols 732, the algorithms 733, and/or the stored data 734 according to some example embodiments. Each storage unit or device can be physically located in the same or in a different geographic location.

The storage repository 730 can be operatively connected to the control engine 706. In one or more example embodiments, the control engine 706 includes functionality to communicate with a user 750 (including an associated user system 755), one or more of the sensor devices 660, and/or the network manager 780 in the system 600. More specifically, the control engine 706 sends information to and/or receives information from the storage repository 730 in order to communicate with a user 750 (including an associated user system 755), one or more of the sensor devices 660, and/or the network manager 780. As discussed below, the storage repository 730 can also be operatively connected to the communication module 708 in certain example embodiments.

In certain example embodiments, the control engine 706 of the controller 704 controls the operation of one or more components (e.g., the communication module 708, the timer 710, the transceiver 724) of the controller 704. For example, the control engine 706 can activate the communication module 708 when the communication module 708 is in "sleep" mode and when the communication module 708 is needed to send data received from another component (e.g., a user system 755 of a user 750, a sensor device 660) in the system 600.

As another example, the control engine 706 can acquire the current time using the timer 710. As yet another example, the control engine 706 can direct the energy metering module 711 to measure and send power consumption information to the network manager 780. As still another example, the control engine 706 of the controller 704 can send measurements made by the sensor devices 660 and/or outputs of algorithms 733 to the network manager 780.

The control engine 706 can be configured to perform a number of functions that help the controller 704 evaluate the performance of a choke valve in real time during a subterranean field operation. As discussed above, the control engine 706 can execute any of the protocols 732 and/or the algorithms 733, using stored data 734 stored in the storage repository 730, to automatically evaluate the performance of the choke valve 670 in real time during a subterranean field operation. In certain example embodiments, the control engine 706 controls the frequency at which a sensor device 660 measures a parameter during a subterranean field operation.

The control engine 706 can use one or more of the algorithms 733 and/or protocols 732 to predict a relationship between flow area through the choke valve 670 and the position of the plug (e.g., plug 339) of the choke valve 670 (indicating the amount that the choke valve 670 is open or closed) over time. As another example, the control engine 706 can use one or more of the algorithms 733 and/or protocols 732 to estimate, in real time, a flow area through the choke valve 670 in real time using parameters (e.g., pressure, temperature, flow rate) measured by at least some of the sensor devices 660. As another example, the control engine 706 can use one or more of the algorithms 733 and/or protocols 732 to determine, in real time, that the performance of the choke valve 670 is no longer within a range of acceptable performance values based on the estimated flow area and the predicted flow area.

As still another example, the control engine 706 can use one or more of the algorithms 733 and/or protocols 732 to determine an amount of adjustment of the position of the plug of the choke valve 670 that should be made to extend the useful life of the choke valve 670 by reducing the amount of erosion or obstruction that the choke valve 670 experiences. As yet another example, the control engine 706 can use one or more of the algorithms 733 and/or protocols 732 to revise the predicted relationship between flow area through the choke valve 670 and the position of the plug of the choke valve 670 over time, looking forward, during a subterranean field operation.

In certain example embodiments, with a subsea field operation, if some of the sensor devices 660 (e.g., the sensor devices 660-1 that are located upstream of the choke valve 670) are taking measurements of parameters at the surface, the control engine 706 can use one or more algorithms 733 and/or protocols 732 to convert the measurements to subsea conditions. Such a conversion can include the use of a PVT table, stored in the storage repository 730 as stored data, by the controller 704.

In certain example embodiments, the control engine 706 of the controller 704 can use one or more of the algorithms 733 and/or protocols 732 to verify the functionality of one or more of the sensor devices 660, either before or during a subterranean field operation. This functionality of a sensor device 660 can be directed to a specific component (e.g., a sensor) of the sensor device 660 or cover a full spectrum of the functional capability of the sensor device 660. In performing this function, the control engine 706 can perform calibrations and/or establish settings of a sensor device 660 or one or more of its components. For example, the control engine 706 can calibrate a sensor device 660 that measures pressure. As another example, the control engine 706 can test and upload settings (e.g., detection settings, actions to take upon detecting a flow rate, hold time, actions to take when failing to detect a flow rate) with respect to a sensor device 660 that measures a flow rate.

The control engine 706 can cause control, communication, and/or other similar signals to be generated and sent to a user 750 (including an associated user system 755), one or more of the sensor devices 660, and/or the network manager 780. Similarly, the control engine 706 can execute certain instructions based on control, communication, and/or other similar signals received from a user 750 (including an associated user system 755), one or more of the sensor devices 660, and/or the network manager 780. The control engine 706 can control each sensor device 660 automatically (for example, based on one or more protocols 732 or algorithms 733 stored in the storage repository 730) and/or based on control, communication, and/or other similar signals received from another device or component of the system 600 through a communication link 705.

In certain embodiments, the control engine 706 of the controller 704 can communicate with one or more components of a system external to the system 600 in furtherance of evaluating performance of the choke valve 670 in real time during a subterranean field operation. For example, the control engine 706 can interact with an inventory management system by ordering a replacement choke valve when the control engine 706 has determined that the choke valve 670 has failed or is about to fail as a result of excessive erosion or congestion. As another example, the control engine 706 can interact with a logistics system by scheduling one or more modes of transportation (e.g., truck, train, helicopter, boat) to get a replacement choke valve to the site of the subterranean field operation so that the choke valve 670 can be replaced. In this way, the controller 704 is capable of performing a number of functions beyond what is performed within the system 600 shown in FIG. 6.

A user 750 (including an associated user system 755), one or more of the sensor devices 660, and/or the network manager 780 can interact with the controller 704 using the application interface 726 in accordance with one or more example embodiments. Specifically, the application interface 726 of the controller 704 receives data (e.g., information, communications, instructions, updates to firmware) from and sends data (e.g., information, communications, instructions) to a user 750 (including an associated user system 755), one or more of the sensor devices 660, and/or the network manager 780. A user 750 (including an associated user system 755), one or more of the sensor devices 660, and/or the network manager 780 can include an interface to receive data from and send data to the controller 704 in certain example embodiments. Examples of such an interface can include, but are not limited to, a graphical user interface, a touchscreen, an application programming interface, a keyboard, a monitor, a mouse, a web service, a data protocol adapter, some other hardware and/or software, or any suitable combination thereof.

In some cases, the application interface 726 of the controller 704 can enable the control engine 706 to communicate with one or more components (e.g., a sensor device 660, the network manager 780) of the system 600 using a particular interface. For example, if the controller 704 operates under IEC Standard 62386, then the controller 704 can have a serial communication interface that will transfer data (e.g., stored data 734) measured by one or more of the sensor devices 660. In such a case, a user system 755 can also include a serial interface to enable communication with the controller 704. Such an interface can operate in conjunction with, or independently of, the protocols 732 used to communicate between the controller 704 and a user 750 (including an associated user system 755), one or more of the sensor devices 760, and/or, the network manager 780.

The control engine 706 (or other components of the controller 704) can also include one or more hardware components and/or software elements to perform its functions. Such components can include, but are not limited to, a universal asynchronous receiver/transmitter (UART), a serial peripheral interface (SPI), a direct-attached capacity (DAC) storage device, an analog-to-digital converter, an inter-integrated circuit (I2C), and a pulse width modulator (PWM).

The communication module 708 of the controller 704 determines and implements the communication protocol (e.g., from the protocols 732 of the storage repository 730) that is used when the control engine 706 communicates with (e.g., sends signals to, receives signals from) a user 750 (including an associated user system 755), one or more of the sensor devices 660, and/or, the network manager 780. In some cases, the communication module 708 accesses the stored data 734 to determine which communication protocol is used to communicate with another component of the system 600. In addition, the communication module 708 can interpret the communication protocol of a communication received by the controller 704 so that the control engine 706 can interpret the communication.

The communication module 708 can send and receive data between the network manager 780, the sensor devices 660, and/or the users 750 (including associated user systems 755) and the controller 704. The communication module 708 can send and/or receive data in a given format that follows a particular protocol 732. The control engine 706 can interpret the data packet received from the communication module 708 using the protocol 732 information stored in the storage repository 730. The control engine 706 can also facilitate the data transfer between one or more sensor devices 660 and the network manager 780 and/or a user 750 (including an associated user system 755) by converting the data into a format understood by the communication module 708.

The communication module 708 can send data (e.g., protocols 732, algorithms 733, stored data 734, operational information, threshold values, acceptable performance values, results of algorithms 733) directly to and/or retrieve data directly from the storage repository 730. Alternatively, the control engine 706 can facilitate the transfer of data between the communication module 708 and the storage repository 730. The communication module 708 can also provide encryption to data that is sent by the controller 704 and decryption to data that is received by the controller 704. The communication module 708 can also provide one or more of a number of other services with respect to data sent from and received by the controller 704. Such services can include, but are not limited to, data packet routing information and procedures to follow in the event of data interruption.

The timer 710 of the controller 704 can track clock time, intervals of time, an amount of time, and/or any other measure of time. The timer 710 can also count the number of occurrences of an event, whether with or without respect to time. Alternatively, the control engine 706 can perform the counting function. The timer 710 is able to track multiple time measurements concurrently. The timer 710 can track time periods based on an instruction received from the control engine 706, based on an instruction received from the user 750 (or an associated user system 755), based on an instruction programmed in the software for the controller 704, based on some other condition or from some other component, or from any combination thereof.

The timer 710 can be configured to track time when there is no power delivered to the controller 704 (e.g., the power module 712 malfunctions) using, for example, a super capacitor or a battery backup. In such a case, when there is a resumption of power delivery to the controller 704, the timer 710 can communicate any aspect of time to the controller 704. In such a case, the timer 710 can include one or more of a number of components (e.g., a super capacitor, an integrated circuit) to perform these functions.

The energy metering module 711 of the controller 704 measures one or more components of energy (e.g., electrical current, electrical voltage, resistance, VARs, watts) at one or more points within the scope of the controller 704. The energy metering module 711 can include any of a number of measuring devices and related devices, including but not limited to a voltmeter, an infrared detector, an ammeter, a power meter, an ohmmeter, a current transformer, a potential transformer, a sensing resistor, and electrical wiring. The energy metering module 711 can measure a component of energy continuously, periodically, based on the occurrence of an event, based on a command received from the control engine 706, and/or based on some other factor. The energy metering module 711 can be part of, or separate from, the sensor devices 660.

The power module 712 of the controller 704 provides power to one or more other components (e.g., timer 710, control engine 706) of the controller 704. The power module 712 can include one or more of a number of single or multiple discrete components (e.g., transistor, diode, resistor), and/or a microprocessor. The power module 712 may include a printed circuit board, upon which the microprocessor and/or one or more discrete components are positioned. In some cases, the power module 712 can include one or more components that allow the power module 712 to measure one or more elements of power (e.g., voltage, current) that is delivered to and/or sent from the power module 712. Alternatively, the energy metering module 711 can measure one or more elements of power that flows into, out of, and/or within the power module 712.

The power module 712 can include one or more components (e.g., a transformer, a diode bridge, an inverter, a converter) that receives power (for example, through an electrical cable) from a source external to the controller 704 and generates power of a type (e.g., alternating current, direct current) and level (e.g., 12V, 24V, 120V) that can be used by the other components of the controller 704. The power module 712 can use a closed control loop to maintain a preconfigured voltage or current with a tight tolerance at the output. The power module 712 can also protect the rest of the electronics (e.g., hardware processor 720, transceiver 724) of the controller 704 from surges generated in the line.

In addition, or in the alternative, the power module 712 can be or include a source of power in itself to provide signals to the other components of the controller 704. For example, the power module 712 can be or include a battery. As another example, the power module 712 can be or include a localized photovoltaic power system. The power module 712 can also have sufficient isolation in the associated components of the power module 712 (e.g., transformers, opto-couplers, current and voltage limiting devices) so that the power module 712 is certified to provide power to an intrinsically safe circuit.

In certain example embodiments, the power module 712 of the controller 704 can also provide power and/or control signals, directly or indirectly, to one or more of the sensor devices 660. In such a case, the control engine 706 can direct the power generated by the power module 712 to the sensor devices 660. In this way, power can be conserved by sending power to the sensor devices 660 when the sensor devices 660 need power, as determined by the control engine 706.

The hardware processor 720 of the controller 704 executes software, algorithms (algorithms 733), and firmware in accordance with one or more example embodiments. Specifically, the hardware processor 720 can execute software on the control engine 706 or any other portion of the controller 704, as well as software used by a user 750 (including an associated user system 755), one or more of the sensor devices 660, and/or the network manager 780. The hardware processor 720 can be an integrated circuit, a central processing unit, a multi-core processing chip, SoC, a multi-chip module including multiple multi-core processing chips, or other hardware processor in one or more example embodiments. The hardware processor 720 is known by other names, including but not limited to a computer processor, a microprocessor, a microcontroller, and a multi-core processor.

In one or more example embodiments, the hardware processor 720 executes software instructions stored in memory 722. The memory 722 includes one or more cache memories, main memory, and/or any other suitable type of memory. The memory 722 can include volatile and/or non-volatile memory. The memory 722 is discretely located within the controller 704 relative to the hardware processor 720 according to some example embodiments. In certain configurations, the memory 722 can be integrated with the hardware processor 720.

In certain example embodiments, the controller 704 does not include a hardware processor 720. In such a case, the controller 704 can include, as an example, one or more field programmable gate arrays (FPGA), one or more integrated-gate bipolar transistors (IGBTs), one or more complex programmable logic devices (CPLDs), programmable array logics (PALs), one or more digital signal processors (DSPs), and/or one or more integrated circuits (ICs). Using FPGAs, IGBTs, CPLDs, PALs, DSPs, ICs, and/or other similar devices known in the art allows the controller 704 (or portions thereof) to be programmable and function according to certain logic rules and thresholds without the use of a hardware processor. Alternatively, FPGAs, IGBTs, CPLDs, PALs, DSPs, ICs, and/or similar devices can be used in conjunction with one or more hardware processors 720.

The transceiver 724 of the controller 704 can send and/or receive control and/or communication signals. Specifically, the transceiver 724 can be used to transfer data between the controller 704 and a user 750 (including an associated user system 755), one or more of the sensor devices 660, and/or the network manager 780. The transceiver 724 can use wired and/or wireless technology. The transceiver 724 can be configured in such a way that the control and/or communication signals sent and/or received by the transceiver 724 can be received and/or sent by another transceiver that is part of a user 750 (including an associated user system 755), one or more of the sensor devices, and/or, the network manager 780. The transceiver 724 can use any of a number of signal types, including but not limited to radio frequency signals.

When the transceiver 724 uses wireless technology, any type of wireless technology can be used by the transceiver 724 in sending and receiving signals. Such wireless technology can include, but is not limited to, Wi-Fi, visible light communication (VLC), cellular networking, 802.15.4 wireless, ZigBee, 4G cellular wireless, BLE, and Bluetooth. The transceiver 724 can use one or more of any number of suitable communication protocols (e.g., ISA100, HART) when sending and/or receiving signals. Such communication protocols can be stored in the protocols 732 of the storage repository 730. Further, any transceiver information for a user 750 (including an associated user system 755), one or more of the sensor devices 660, and/or the network manager 780 can be part of the stored data 734 (or similar areas) of the storage repository 730.

Optionally, in one or more example embodiments, the security module 728 secures interactions between the controller 704, a user 750 (including an associated user system 755), one or more of the sensor devices 660, and/or the network manager 780. More specifically, the security module 728 authenticates communication from software based on security keys verifying the identity of the source of the communication. For example, user software may be associated with a security key enabling the software of a user system 755 of a user 750 to interact with the controller 704 and/or the sensor devices 660. Further, the security module 728 can restrict receipt of information, requests for information, and/or access to information in some example embodiments.

Figure 8:
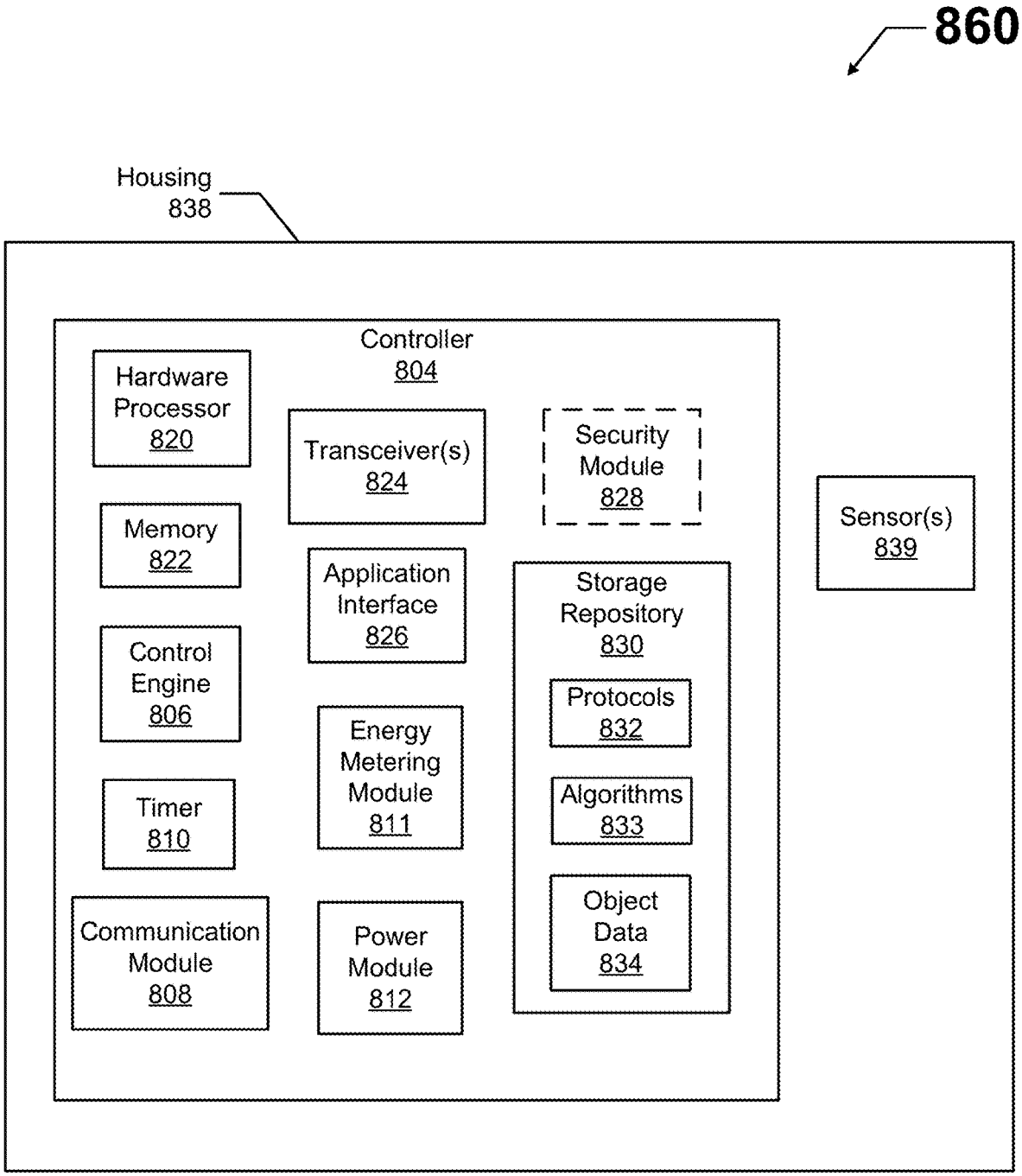
FIG. 8 shows an integrated sensor device that can be used in the system of FIG. 6.

FIG. 8 shows a diagram of an integrated sensor module 660 that can be used in the system 600 of FIG. 6. Referring to FIGS. 1 through 8, the integrated sensor module 660 of FIG. 8 can include one or more of a number of components. Such components, can include, but are not limited to, a controller 804 (which can include, for example, a control engine 806, a communication module 808, a timer 810, an energy storage device 811, a power module 812, a storage repository 830 (which includes protocols 832, algorithms 833, and stored data 834), a hardware processor 820, a memory 822, one or more transceivers 824, an application interface 826, and, optionally, a security module 828) and one or more sensors 839. The components shown in FIG. 8 are not exhaustive, and in some embodiments, one or more of the components shown in FIG. 8 may not be included in an integrated sensor device 660. Any component of the integrated sensor device 660 can be discrete, combined with one or more other components of the integrated sensor device 660, and/or shared with the controller 704. The sensor device 660 can correspond to a computer system as described below with regard to FIG. 9.

The control engine 806, the communication module 808, the timer 810, the energy metering module 811, the power module 812, the storage repository 830 (which can includes protocols 831, algorithms 832, and object data 834), the hardware processor 820, the memory 822, the one or more transceivers 824, the application interface 826, and the security module 828 of the controller 804 of the sensor device 660 can be substantially the same as the corresponding components of the controller 704 discussed above with respect to FIG. 7. Each of the one or more sensors 839 of the integrated sensor device 660 are the components that actually measure one or more parameters. An example of a sensor 839 can include, but is not limited to, a flow rate sensor, a pressure sensor, and a temperature sensor. Each component of the integrated sensor device 660 can be disposed within, on, or external from a housing 838 of the integrated sensor device 660.

Figure 9:
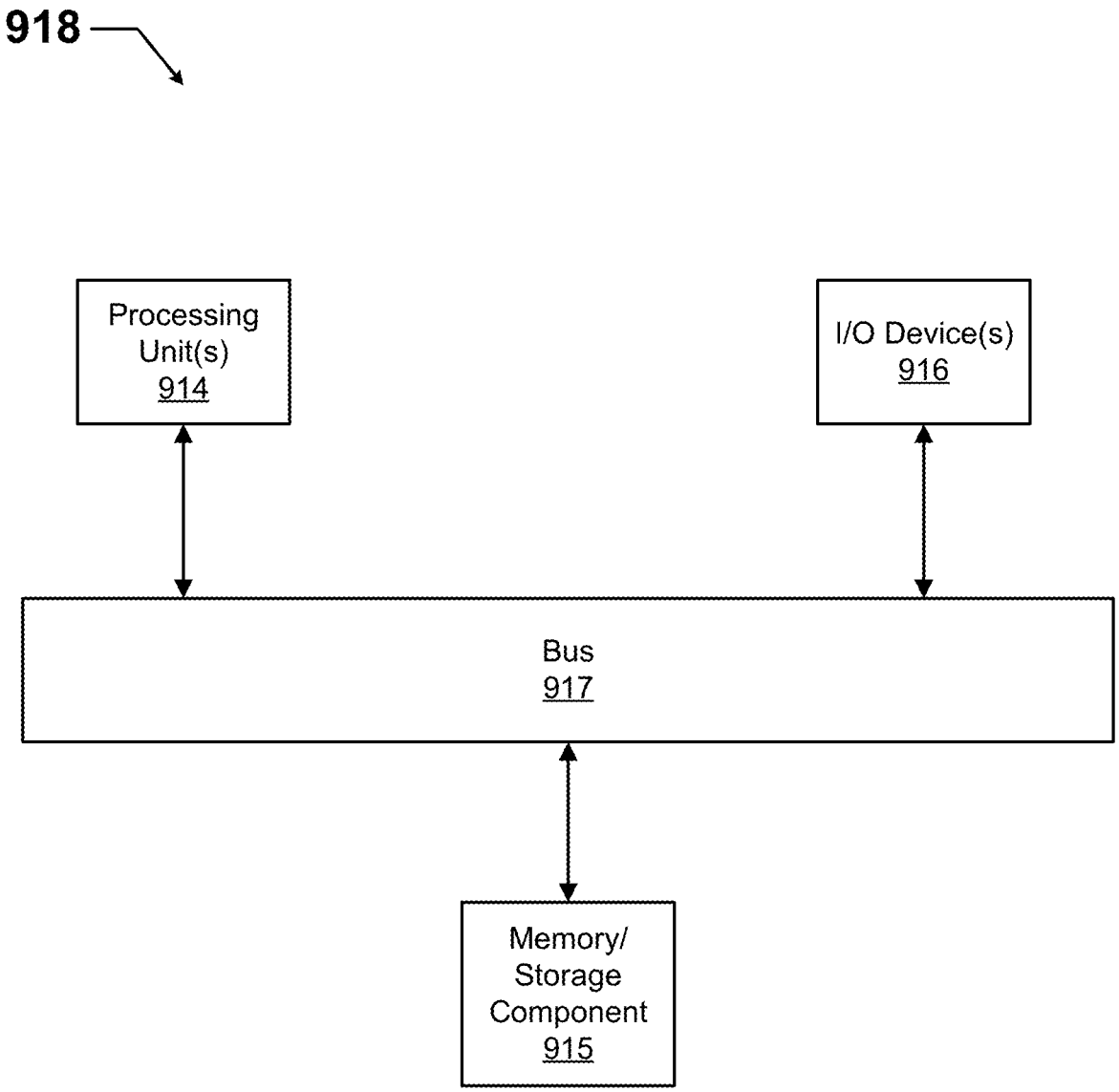
FIG. 9 shows a diagram of a computing system according to certain example embodiments.

FIG. 9 shows a computing device 918 according to certain example embodiments. FIG. 9 illustrates one embodiment of a computing device 918 that implements one or more of the various techniques described herein, and which is representative, in whole or in part, of the elements described herein pursuant to certain example embodiments. For example, computing device 918 can be implemented in the form of the controller 704 (which can include a hardware processor, memory, and a storage repository, among other components) of FIG. 7. Computing device 918 is one example of a computing device and is not intended to suggest any limitation as to scope of use or functionality of the computing device and/or its possible architectures. Neither should computing device 918 be interpreted as having any dependency or requirement relating to any one or combination of components illustrated in the example computing device 918.

Computing device 918 includes one or more processors or processing units 914, one or more memory/storage components 915, one or more input/output (I/O) devices 916, and a bus 917 that allows the various components and devices to communicate with one another. Bus 917 represents one or more of any of several types of bus structures, including a memory bus or memory controller, a peripheral bus, an accelerated graphics port, and a processor or local bus using any of a variety of bus architectures. Bus 917 includes wired and/or wireless buses.

Memory/storage component 915 represents one or more computer storage media. Memory/storage component 915 includes volatile media (such as random access memory (RAM)) and/or nonvolatile media (such as read only memory (ROM), flash memory, optical disks, magnetic disks, and so forth). Memory/storage component 915 includes fixed media (e.g., RAM, ROM, a fixed hard drive, etc.) as well as removable media (e.g., a Flash memory drive, a removable hard drive, an optical disk, and so forth).

One or more I/O devices 916 allow a customer, utility, or other user to enter commands and information to computing device 918, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 918 is connected to a network (not shown) (e.g., a LAN, a WAN such as the Internet, cloud, or any other similar type of network) via a network interface connection (not shown) according to some exemplary embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other exemplary embodiments. Generally speaking, the computer system 918 includes at least the minimal processing, input, and/or output means necessary to practice one or more embodiments.

Further, those skilled in the art will appreciate that one or more elements of the aforementioned computer device 918 is located at a remote location and connected to the other elements over a network in certain exemplary embodiments. Further, one or more embodiments is implemented on a distributed system having one or more nodes, where each portion of the implementation (e.g., control engine 706) is located on a different node within the distributed system. In one or more embodiments, the node corresponds to a computer system. Alternatively, the node corresponds to a processor with associated physical memory in some exemplary embodiments. The node alternatively corresponds to a processor with shared memory and/or resources in some exemplary embodiments.

Figure 10:
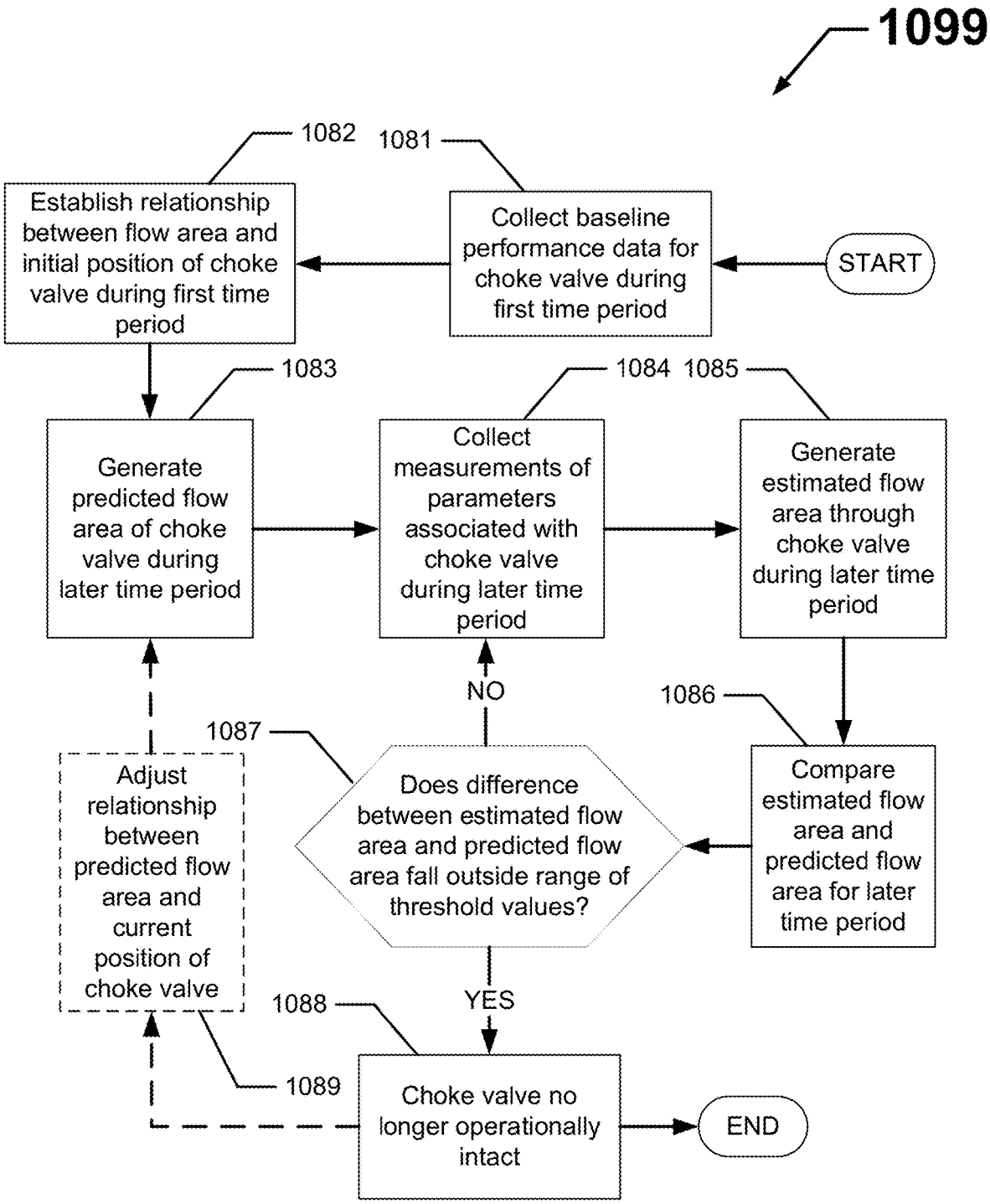
FIG. 10 shows a flowchart of a method for evaluating choke valve performance during subterranean field operations according to certain example embodiments.

FIG. 10 shows a flowchart 1099 of a method for evaluating choke valve performance during subterranean field operations according to certain example embodiments. While the various steps in this flowchart 1099 are presented sequentially, one of ordinary skill will appreciate that some or all of the steps may be executed in different orders, may be combined or omitted, and some or all of the steps may be executed in parallel. Further, in one or more of the example embodiments, one or more of the steps shown in this example method may be omitted, repeated, and/or performed in a different order.

In addition, a person of ordinary skill in the art will appreciate that additional steps not shown in FIG. 10 may be included in performing this method. Accordingly, the specific arrangement of steps should not be construed as limiting the scope. Further, a particular computing device, such as the computing device discussed above with respect to FIG. 9, can be used to perform one or more of the steps for the methods shown in FIG. 10 in certain example embodiments. Any of the functions performed below by the controller 704 can involve the use of one or more protocols 732, one or more algorithms 733, and/or stored data 734.

The method shown in FIG. 10 is merely an example that can be performed by using an example system described herein. In other words, systems for evaluating the performance of a choke valve (e.g., choke valve 670) in real time during a subterranean field operation can perform other functions using other methods in addition to and/or aside from those shown in FIG. 10. Referring to FIGS. 1 through 10, the method shown in the flowchart 1099 of FIG. 10 begins at the START step and proceeds to step 1081, where baseline performance data of a choke valve 670 during a first time period is collected. The baseline performance data can be collected by the controller 704. The baseline performance data can originate from one or more of a number of sources, including but not limited to multiple sensor devices 660, the network manager 780, and a user 750.

The baseline performance data can include, but is not limited to, measurements of parameters (e.g., flow rate, temperature, pressure) made by the sensor devices 660, the position of the choke valve 670, nameplate data for the choke valve 670, manufacturing performance curves for the choke valve 670, historical data associated with other choke valves having the same make and manufacturer as the choke valve 670 used in the present subterranean field operation, and data associated with other subterranean field operations having similar subterranean characteristics as the subterranean formation used in the present subterranean field operation. In certain example embodiments, the first time period is a period of time starting with commencement of the subterranean field operation during which the choke valve 670 is unlikely to experience any appreciable erosion or congestion as multiphase fluid flow therethrough. An example of a first period of time can be 30 days.

In step 1082, a relationship is established between the flow area through the choke valve 670 and the initial position of the choke valve 670 during the first time period. The relationship between the flow area through the choke valve 670 and the initial position of the choke valve 670 during the first time period can be established by the controller 704. The data used to establish the relationship between the flow area through the choke valve 670 and the initial position of the choke valve 670 during the first time period can be the same data and can originate from the same sources as discussed above with respect to step 1081. The relationship can be expressed in the form of a graph, such as the graph 595 shown in FIG. 5 above. Specifically, the relationship can be equivalent to the performance curve 563 shown in the graph 595 of FIG. 5.

In step 1083, a predicted flow area through the choke valve 670 for a later time period is generated. The predicted flow area through the choke valve 670 for a later time period can be generated by the controller 704. The predicted flow area through the choke valve 670 can be based, at least in part, on the relationship developed in step 1082. The predicted flow area through the choke valve 670 can also be based, at least in part, on the results of one or more algorithms 733 run by the controller 704. The later time period can be for a period of time that immediately follows the end of the first time period. Alternatively, the later time period can be for any period of time after the first time period ends. The length of a time period herein can be based on one or more of a number of factors, including but not limited to an amount of data points measured and/or calculated.

In certain example embodiments, when the first time period is an initial time period during a field operation, the predicted flow area is based on an assumption that the flow area through the performance of the choke valve 670 is within a range of acceptable performance values (e.g., no substantial erosion or congestion) relative to the initial time period (e.g., 3 months, 6 months, 12 months). In alternative embodiments, the first time period is some period of time during a field operation after the field operation has passed an initial phase. In cases where the method involves generating a predicted flow area of the choke valve 670 at a point in time after the first time period, then the predicted flow area can be based on the most recent assumption as to the status of the choke valve 670. In such cases, the performance curve 563 shown in the graph 595 of FIG. 5 is adjusted based on information (e.g., measurements made by the sensor devices 660, most recent estimated flow rate of the choke valve 670) collected since the initial time period.

In step 1084, measurements of parameters associated with the choke valve 670 during the later time period are collected. The measurements can be differential measurements of parameters (e.g., pressure, temperature, flow rate) made by the sensor devices 660-1 (downstream of the choke valve 670) and the sensor devices 660-2 (upstream of the choke valve 670). For example, three of the sensor devices 660-1 can measure pressure, temperature, flow rate upstream of the choke valve 670 at a point in time, and three of the sensor devices 660-2 can measure pressure, temperature, flow rate downstream of the choke valve 670 at the same point in time. The later period of time in which the measurements are collected coincide with the later period of time in which the predicted flow area is generated in step 1083.

In step 1085, an estimated flow area through the choke valve 670 during the later time period is generated. The estimated flow area through the choke valve 670 during the later time period can be generated by the controller 704 using one or more algorithms 733 and the measurements collected in step 1084. In step 1086, the estimated flow area through the choke valve 670 (as generated in step 1084) is compared to the predicted flow area through the choke valve 670 (as generated in step 1083) for the later period of time. This comparison can be made by the controller 704 using one or more algorithms 733. The comparison can be made relative to some benchmark, such as a threshold value or a range of threshold values, which is stored in the storage repository 730 as stored data 734.

In step 1087, a determination is made as to whether the difference between the estimated flow area through the choke valve 670 (as generated in step 1084) and the predicted flow area through the choke valve 670 (as generated in step 1083) for the later period of time falls outside a range of threshold values. The determination can be made by the controller 704. In some cases, some other benchmark can be used instead of a threshold value or range of threshold values. For example, a protocol 732 can require the controller 704 to find multiple (e.g., at least 3, at least 10) data points that fall outside the range of threshold values within a period of time (e.g., the last 60 minutes) before the controller 704 can determine that the difference between the estimated flow area and the predicted flow area falls outside the range of threshold values (e.g., exceeds a threshold value to indicate erosion of the choke valve 670, falls below a threshold value to indicate congestion within the choke valve 670).

If the difference between the estimated flow area through the choke valve 670 and the predicted flow area through the choke valve 670 for the later period of time falls outside the range of threshold values, then the process proceeds to step 1088. If the difference between the estimated flow area through the choke valve 670 and the predicted flow area through the choke valve 670 for the later period of time falls outside the range of threshold values, then the process reverts to step 1084.

In step 1088, a determination is made that the performance of the choke valve 670 is no longer within a range of acceptable performance values. This determination can be made by the controller 704. In certain example embodiments, a communication can be generated by the controller 704 and sent to one or more users 750 to communicate that the performance of the choke valve 670 is no longer within a range of acceptable performance values. This communication can include any of a number of different types of information, including but not limited to a basic statement that the choke valve 670 is failing or operating sub-optimally, whether the choke valve 670 is experiencing erosion or congestion, the severity of the erosion or congestion of the choke valve 670, and specific actions (e.g., a number of turns clockwise or counterclockwise to apply to the actuator 335 of the choke valve 370) that can be taken to reduce the rate of deterioration of the choke valve 670.

Once step 1088 has concluded, the method can proceed to the END step. Alternatively, if the subterranean field operation is continuing after the completion of step 1088, then the process can proceed to step 1089. In step 1089, the relationship between the predicted flow area and the current position (e.g., amount of openness) of the choke valve 670 is adjusted. The relationship between the predicted flow area and the current position of the choke valve 670 can be adjusted by the controller 704 using one or more algorithms 733 and/or protocols 732.

The relationship between the predicted flow area and the current position can also be adjusted based on the actual measurements made by the sensor devices 660 up to that point in time during the subterranean field operation. The adjustment to the relationship essentially resets the performance curve of the choke valve on a go-forward basis for the duration of the subterranean field operation. The adjustment to the relationship can be for only the current position of the choke valve 670, all possible positions of the choke valve 670, or a range of positions of the choke valve 670.

Figure 11:
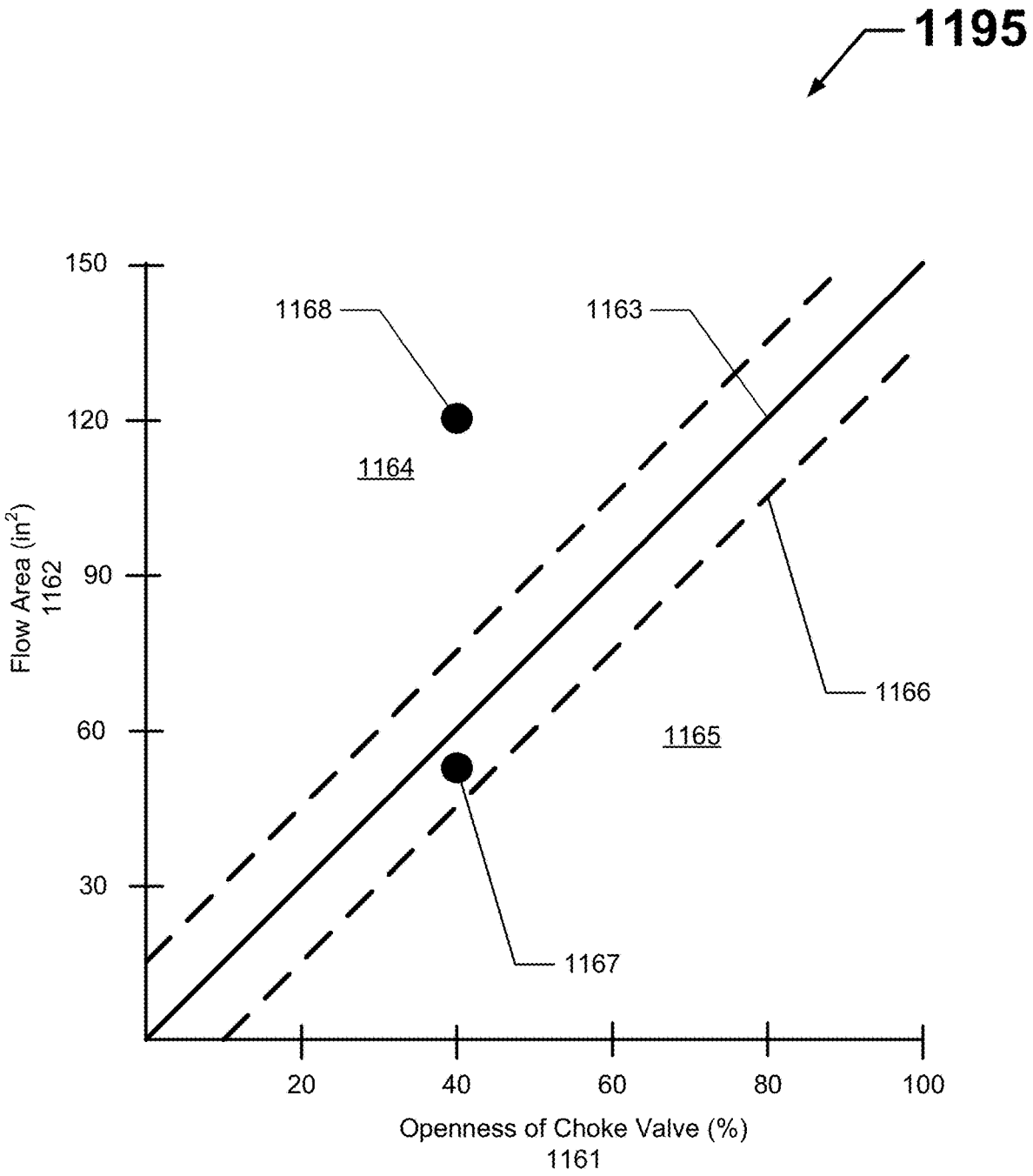
FIG. 11 shows another graph of a performance curve for a choke valve according to certain example embodiments.

FIG. 11 shows another graph 1195 of a performance curve 1163 for a choke valve according to certain example embodiments. Referring to FIGS. 1 through 11, the graph 1195 of FIG. 11 plots a flow area 1162 along the vertical axis versus the openness of the choke valve 1161 along the horizontal axis. The performance curve 1163 of the graph 1195 captures the predicted flow area through the choke valve over a range of openness of the choke valve at some point or period of time after the initial time period of the subterranean field operation in which the choke valve is used. In this case, the resulting performance curve 1163 (such as what is generated in step 1083 in the method of FIG. 10 above) rises substantially linearly. If one or more channels of the choke valve are eroded, as shown in FIG. 4B, then plot points land in the area 1164 above the performance curve 1163. Similarly, if one or more channels of the choke valve are congested, as shown in FIG. 4C, then plot points land in the area 1165 below the performance curve 1163.

The graph 1195 in this case also includes a range of threshold values 1166 that in this case are set at approximately a plus or minus 5 percent variation from the performance curve 1163. The variation can be determined using any of a number of statistical methods (e.g., root-mean-square error) that is statistically meaningful for the range of threshold values 1166. The range of threshold values 1166 represents points beyond which variation from the performance curve 1163 require action according to certain example embodiments. When the choke valve is 40% open, if a predicted flow area, as generated by the controller (e.g., controller 704) using measurements made by the sensor devices (e.g., sensor devices 660) and one or more algorithms (e.g., algorithms 733), is approximately 52.5 $in^2$, as shown by data point 1167 on the graph 1195, indicating slight congestion of the channels of the choke valve, the controller will decide not to recommend any corrective action with respect to the choke valve at that time because the data point falls within the range of threshold values 1166.

By contrast, when the choke valve is 40% open within the same period of time (e.g., the same hour, the same day, the same week, the same month) as when data point 1167 occurred, if a predicted flow area, as generated by the controller (e.g., controller 704) using measurements made by the sensor devices (e.g., sensor devices 660) and one or more algorithms (e.g., algorithms 733), is approximately 120 $in^2$, as shown by data point 1168 on the graph 1195, indicating slight erosion of the channels of the choke valve, the controller may decide to recommend corrective action with respect to the choke valve at that time because the data point falls outside the range of threshold values 1166. Alternatively, the controller may elect to collect a minimum number of data points within a range of time to determine if the data points indicate a consistent pattern (e.g., slightly eroded, severely congested) with respect to the estimated flow area of the choke valve. In such a case, one or more protocols (e.g., protocols 732) and/or algorithms (e.g., algorithms 733) can be used to determine if and when a recommendation is made by the controller to adjust the choke valve.

The range of threshold values 1166 can be set by the controller (e.g., based on experience with past data), a user, by default, and/or by some other component or method. The range of threshold values 1166 do not need to be symmetrical around the performance curve 1163 over all percentages of openness of the choke valve 1161. If the controller determines that a recommendation to adjust the choke valve should be made, then the controller may use one or more algorithms to adjust the performance curve (including the range of threshold values) of the choke valve going forward. During the course of a subterranean field operation, multiple adjustments can be made to the performance curve, as shown in FIG. 12 below.

Figure 12:
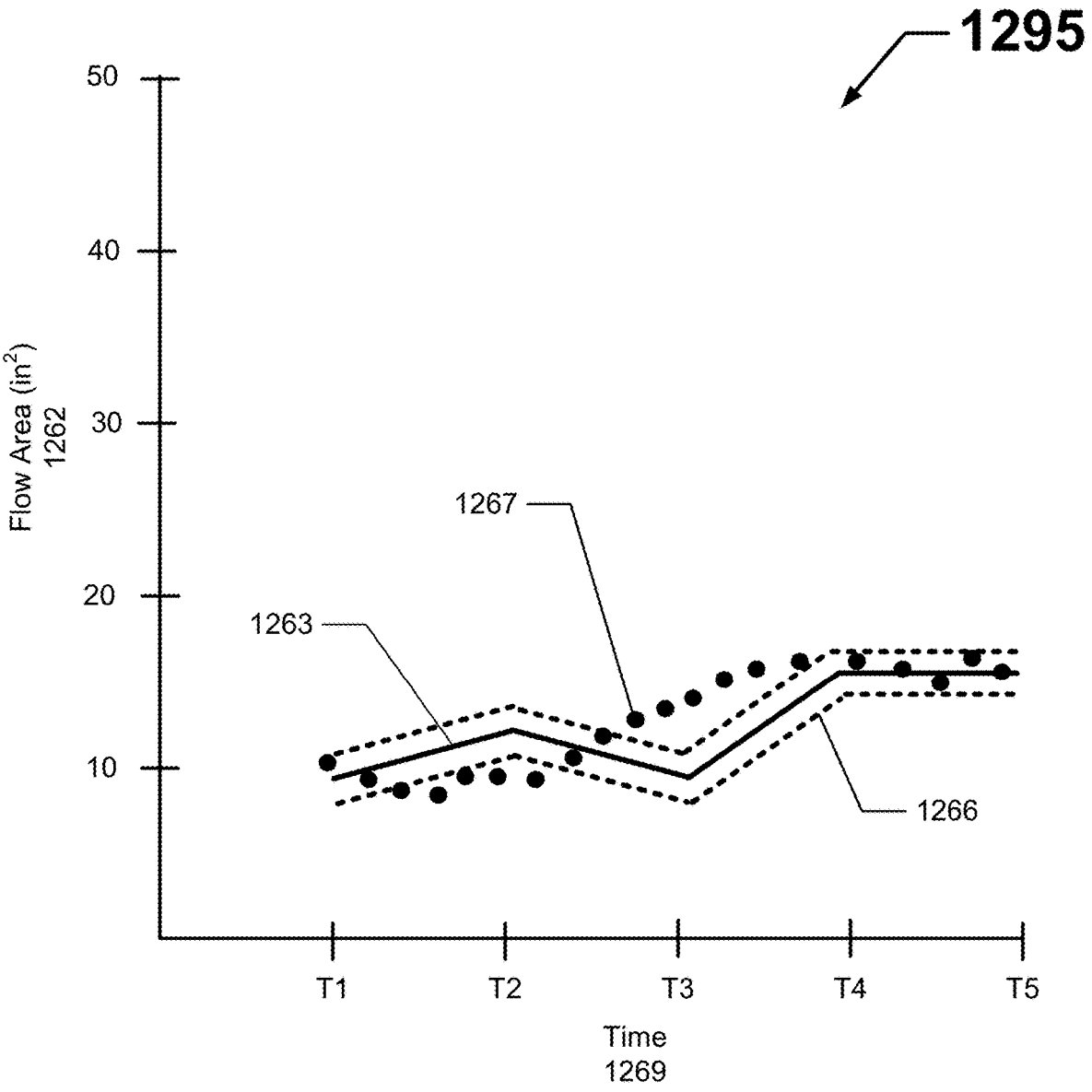
FIG. 12 shows yet another graph of a performance curve for a choke valve according to certain example embodiments.

FIG. 12 shows yet another graph 1295 of a performance curve 1263 for a choke valve 670 according to certain example embodiments. Referring to FIGS. 1 through 12, the graph 1295 of FIG. 12 plots a flow area 1262 along the vertical axis versus time 1269 along the horizontal axis. The designations (T1, T2, T3, T4, and T5) of time 1269 may represent equal increments (e.g., days, weeks, months, years) in time. Alternatively, the designations of time 1269 may represent unequal increments of time. The performance curve 1263 of the graph 1295 captures the predicted flow area through the choke valve 670 from T1 through T5, which occur after the initial time period of the subterranean field operation in which the choke valve 670 is used.

In this case, the resulting performance curve 1263 (such as what is generated in step 1083 in the method of FIG. 10 above) is substantially linear for each of the four increments of time captured in the graph 1295. The performance curve 1263 in the graph 1295 is surrounded by a range of threshold values 1266 for all four increments of time. There are also a number of data points 1267 plotted on the graph 1295. The data points 1267 are similar to the data point 1167 and data point 1168 of FIG. 11. Specifically, the data points 1267 represent estimated values of flow area, based on measurements from the sensor devices 660 and one or more algorithms 733, through the choke valve 670 at different points in time. Each data point 1267 in this case can represent a single estimate of the flow area through the choke valve 670. Alternatively, each data point 1267 can represent an average, a median, or some other measure of multiple data points taken over a relatively short period of time.

As each data point 1267 is established, the controller (e.g., controller 704) compares the estimated value of the flow area represented by that data point 1267 to the predicted value of the flow area represented by the performance curve 1263 and accompanying range of threshold values 1266 at that point in time. The controller then uses one or more protocols 732 and/or algorithms 733 to determine whether an adjustment to the setting of the choke valve 670 should be made. When the setting of the choke valve 670 is made, the performance curve 1263 and associated range of threshold values 1266 are also adjusted.

For example, from T1 to T2, the first two data points 1267 have values within the range of threshold values 1266, but then the final four data points 1267 in this increment of time fall below the range of threshold values 1266, indicating that the choke valve 670 may be plugged at the current setting. As a result, the controller 704 determines, using one or more algorithms 733, that the choke valve 670 should be opened more at time T2. The controller 704 may also provide specific instructions (e.g., three full counter-clockwise turns of the actuator 335) as to how to adjust the choke valve 670. The trigger to make this determination by the controller 704 may be driven by one or more protocols 732.

From T2 to T3, the first data point 1267 falls below the range of threshold values 1266, but then the next two data points 1267 in this increment of time fall within the range of threshold values 1266. The last 2 increments from T2 to T3 are increasingly above the range of threshold values, indicating that the choke valve may be eroding at the current setting. As a result, the controller 704 determines, using one or more algorithms 733, that the choke valve 670 should be closed more at time T3. The controller 704 may also provide specific instructions (e.g., two full clockwise turns of the actuator 335) as to how to adjust the choke valve 670.

From T3 to T4, the first four data points 1267 continue to fall above the range of threshold values 1266, albeit at a decreasing amount, and the final data point 1267 in the increment of time from T3 to T4 is approximately at the upper limit of the range of threshold values 1266, indicating that the adjusting setting of the choke valve at T3 may have been too aggressive. As a result, the controller 704 determines, using one or more algorithms 733, that the choke valve 670 should be open more at time T3. The controller 704 may also provide specific instructions (e.g., one full counter-clockwise turns of the actuator 335) as to how to adjust the choke valve 670. From T4 to T5, all five data points 1267 fall within the range of threshold values 1266.

FIG. 13 shows an example of a surface Christmas tree 1390 used in subterranean field operations. Referring to FIGS. 1 through 13, the surface Christmas tree 1390 of FIG. 13 is substantially the same as the Christmas tree 290 of FIG. 2, except that the surface Christmas tree 1390 of FIG. 13 is located on land as opposed to in water. The surface Christmas tree 1390 of FIG. 13 includes multiple components that are connected to each other. Specifically, the surface Christmas tree 1390 includes a sensor device 1360, a tree adaptor 1361, a crown valve 1362, a production wing valve 1363, a choke valve 1370, a kill wing valve 1364, an upper master valve 1365, a lower master valve 1366, and a tubing head adaptor 1367. The choke valve 1370 is designed to throttle a flow area to control flow rate and pressure.

A system used for field operations in which example systems and methods for evaluating choke valve performance are used includes multiple components that are described herein, where a component can be made from a single piece (as from a mold or an extrusion). When a component (or portion thereof) of a system used in a field operation is made from a single piece, the single piece can be cut out, bent, stamped, and/or otherwise shaped to create certain features, elements, or other portions of the component. Alternatively, a component (or portion thereof) of a system used in a field operation can be made from multiple pieces that are mechanically coupled to each other. In such a case, the multiple pieces can be mechanically coupled to each other using one or more of a number of coupling methods, including but not limited to adhesives, welding, fastening devices (e.g., bolts), compression fittings, mating threads, and slotted fittings. One or more pieces that are mechanically coupled to each other can be coupled to each other in one or more of a number of ways, including but not limited to fixedly, hingedly, rotatably, removably, slidably, and threadably.

Components and/or features described herein can include elements that are described as coupling, fastening, securing, or other similar terms. Such terms are merely meant to distinguish various elements and/or features within a component or device and are not meant to limit the capability or function of that particular element and/or feature. For example, a feature described as a "coupling feature" can couple, secure, abut against, fasten, and/or perform other functions aside from merely coupling. In addition, each component and/or feature described herein (including each component of an example system for evaluating choke valve performance during subterranean field operations) can be made of one or more of a number of suitable materials, including but not limited to metal (e.g., stainless steel), ceramic, rubber, glass, and plastic.

A coupling feature (including a complementary coupling feature) as described herein can allow one or more components and/or portions of a system used in a field operation, including an example system for evaluating choke valve performance, to become mechanically coupled, directly or indirectly, to another portion and/or component of the system used in the field operation. A coupling feature can include, but is not limited to, a portion of a hinge, an aperture, a recessed area, a protrusion, a slot, a spring clip, a tab, a detent, and mating threads. One portion of a system used in a field operation can be coupled to another portion and/or component of the system by the direct use of one or more coupling features.

In addition, or in the alternative, a portion of an example system used in a field operation, including an example system for evaluating choke valve performance, can be coupled to another portion of the system using one or more independent devices that interact with one or more coupling features disposed on a component of the system. Examples of such devices can include, but are not limited to, a pin, a hinge, a fastening device (e.g., a bolt, a screw, a rivet), an adapter, and a spring. One coupling feature described herein can be the same as, or different than, one or more other coupling features described herein. A complementary coupling feature as described herein can be a coupling feature that mechanically couples, directly or indirectly, with another coupling feature.

Example embodiments can be used to provide for real time evaluation of the performance of a choke valve used in subterranean field operations, particularly when the choke valve is part of a Christmas tree located subsea. Example embodiments are used in cases where multiphase fluids are flowing through the choke valve. Example embodiments can be used to make real time adjustments to the setting of the choke valve so that the choke valve can have an extended useful life in spite of erosion and/or congestion that occurs within the channels of the choke valve. Example embodiments can provide a number of benefits. Such other benefits can include, but are not limited to, reduced use of resources, cost savings, increased flexibility, and compliance with applicable industry standards and regulations.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A method for evaluating performance of a choke valve during a field operation of a subterranean formation, the method comprising:

collecting, based on measurements from a sensor device, baseline performance data for the choke valve during a first time period during the field operation, wherein the choke valve has a fluid flowing therethrough during the first time period;

establishing, based on evaluating the baseline performance data, a relationship between flow areas of the choke valve and positions of the choke valve for the first time period;

generating, using the relationship established for the first time period and assuming that the performance of the choke valve is within a range of acceptable performance values, a predicted flow area of the choke valve during a second time period that proceeds the first time period, wherein the second time period corresponds to a field operation in which the choke valve is used;

collecting, using the sensor device and in real time, measurements of a parameter associated with the choke valve during the second time period;

generating, in real time and using the measurements of the parameter, an estimated flow area through the choke valve during the second time period, wherein the fluid flows through the choke valve during the second time period;

comparing, in real time, the estimated flow area with the predicted flow area for the second time period;

determining, in real time, that the performance of the choke valve is no longer within the range of acceptable performance values when a difference between the estimated flow area and the predicted flow area for the second time period falls outside a range of threshold values; and determining, in real time and based on the difference, an adjusted position of the choke valve to bring the difference within a range of acceptable values during the field operation, wherein the choke valve is adjusted from a current position to the adjusted position during the field operation after determining the adjusted position based on the difference.

2. The method of claim 1, further comprising:

providing instructions as to how to operate the choke valve to the adjusted position.

3. The method of claim 1, wherein the parameter measured by the sensor device comprises a pressure differential upstream and downstream of the choke valve.

4. The method of claim 1, wherein the parameter measured by the sensor device comprises temperatures upstream and downstream of the choke valve.

5. The method of claim 1, wherein the parameter measured by the sensor device comprises a flow rate through the choke valve.

6. The method of claim 1, wherein the parameter measured by the sensor device comprises at least one of a group consisting of a temperature, a pressure, and a flow rate.

7. The method of claim 6, wherein the measurement of the parameter is converted to subsea conditions using a PVT table.

8. The method of claim 1, further comprising:

generating, after determining that the performance of the choke valve is no longer within the range of acceptable performance values, a revised predicted flow area of the choke valve for time periods after the second time period.

9. The method of claim 8, further comprising:

collecting, using the sensor device, additional measurements of the parameter associated with the choke valve during each time period that proceeds the second time period;

generating, using the additional measurements of the parameter, an estimated flow area through the choke valve during the third time period, wherein the fluid flows through the choke valve during the third time period;

comparing the estimated flow area with the revised predicted flow area for each time period after the second time period; and determining that the difference between the estimated flow area with the revised predicted flow area for each time period after the second time period falls outside the range of threshold values.

10. The method of claim 1, further comprising:

collecting, using the sensor device, additional measurements of the parameter associated with the choke valve during a third time period that proceeds the second time period;

generating, using the additional measurements of the parameter, an estimated flow area through the choke valve during the third time period, wherein the fluid flows through the choke valve during the third time period;

comparing the estimated flow area with the predicted flow area for the third time period; and determining that the difference between the estimated flow area with the predicted flow area for the third time period falls outside the range of threshold values.

11. The method of claim 1, wherein the generating the estimated flow area through the choke valve during the second time period further uses the parameter measured by an additional sensor device for another subterranean formation having characteristics similar to those of the subterranean formation.

12. The method of claim 1, wherein the first time period coincides with initial use of the choke value during the field operation.

13. The method of claim 1, further comprising:

determining, in real time and based on the difference, a rate of deterioration of the choke valve.

14. The method of claim 1, further comprising:

determining, in real time and based on the difference, that the choke valve is eroding.

15. A system for evaluating performance of a choke valve during a field operation of a subterranean formation, the system comprising:

a first sensor device for measuring a parameter associated with a fluid upstream of the choke valve during the field operation;

a second sensor device for measuring the parameter associated with the fluid downstream of the choke valve during the field operation; and a controller communicably coupled to the first sensor device and the second sensor device, wherein the controller is configured to:

collect, from the first sensor device and the second sensor device, baseline performance data for the choke valve during a first time period during the field operation, wherein the choke valve has the fluid flowing therethrough during the first time period;

establish, based on evaluating the baseline performance data, a relationship between a flow area of the choke valve and an initial position of the choke valve for the first time period;

generate, using the relationship established for the first time period and assuming that the performance of the choke valve is within a range of acceptable values, a predicted flow area of the choke valve during a second time period that proceeds the first time period, wherein the second time period corresponds to a field operation in which the choke valve is used;

collect, from the first sensor device and the second sensor device and in real time, measurements of the parameter associated with the choke valve during the second time period;

generate, using the measurements of the parameter in real time, an estimated flow area through the choke valve during the second time period, wherein the fluid flows through the choke valve during the second time period;

compare, in real time, the estimated flow area with the predicted flow area for the second time period;

determine, in real time, that the performance of the choke valve is no longer within the range of acceptable performance values when a difference between the estimated flow area and the predicted flow area for the second time period falls outside a range of threshold values; and determine, based on the difference, an adjusted position of the choke valve to bring the difference within a second range of threshold values for a third time period subsequent to the second time period, wherein the choke valve is adjusted from a current position to the adjusted position during the field operation after determining the adjusted position based on the difference.

16. The system of claim 15, wherein the first sensor device comprises at least one of a group consisting of a flow rate sensor, a temperature sensor, and a pressure sensor.

17. The system of claim 15, wherein the first sensor device is positioned proximate to the choke valve.

18. The system of claim 15, wherein the choke valve is positioned on a platform used to conduct the field operation.

19. The system of claim 15, wherein the choke valve is positioned proximate to a seabed.

20. A non-transitory computer readable medium comprising computer readable program code, which when executed by a computer processor, enables the computer processor to:

collect, based on measurements from a sensor device, baseline performance data for a choke valve during a first time period during the subsea field operation, wherein the choke valve has a fluid flowing therethrough during the first time period;

establish, based on evaluating the baseline performance data, a relationship between a flow area of the choke valve and an initial position of the choke valve for the first time period;

generate, using the relationship established for the first time period and assuming that a performance of the choke valve is within a range of acceptable performance values, a predicted flow area of the choke valve during a second time period that proceeds the first time period, wherein the second time period corresponds to a field operation in which the choke valve is used;

collect, using a sensor device and in real time, measurements of a parameter associated with the choke valve during the second time period;

generate, using the measurements of the parameter and in real time, an estimated flow area through the choke valve during the second time period, wherein the fluid flows through the choke valve during the second time period;

compare, in real time, the estimated flow area with the predicted flow area for the second time period;

determine, in real time, that the performance of the choke valve is no longer within the range of acceptable performance values when a difference between the estimated flow area and the predicted flow area for the second time period falls outside the range of threshold values; and determine, in real time and based on the difference, an adjusted position of the choke valve to bring the difference within a range of acceptable values during the field operation, wherein the choke valve is adjusted from a current position to the adjusted position during the field operation after determining the adjusted position based on the difference.

* * * * *